US007164332B2

(12) United States Patent
Kanno et al.

(10) Patent No.: US 7,164,332 B2
(45) Date of Patent: Jan. 16, 2007

(54) RESONATOR

(75) Inventors: Hiroshi Kanno, Osaka (JP); Kazuyuki Sakiyama, Shijonawate (JP); Ushio Sangawa, Ikoma (JP); Tomoyasu Fujishima, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/237,795

(22) Filed: Sep. 29, 2005

(65) Prior Publication Data

US 2006/0017527 A1 Jan. 26, 2006

Related U.S. Application Data

(63) Continuation of application No. PCT/JP04/15142, filed on Oct. 14, 2004.

(30) Foreign Application Priority Data

Oct. 15, 2003 (JP) ..... 2003-354817

(51) Int. Cl.
*H01P 7/08* (2006.01)

(52) U.S. Cl. ..... 333/219

(58) Field of Classification Search ..... 333/175, 333/204, 205, 219

See application file for complete search history.

(56) References Cited

U.S. PATENT DOCUMENTS 4,598,276 A * 7/1986 Tait ..... 340/572.5
6,075,427 A * 6/2000 Tai et al. ..... 333/219
6,411,181 B1 6/2002 Ishikawa et al.

FOREIGN PATENT DOCUMENTS

| | | |
|---|---|---|
| EP | 1 014 469 A2 | 6/2000 |
| EP | 1 168 483 A2 | 1/2002 |
| JP | 5-37214 | 2/1993 |
| JP | 2000-244213 | 9/2000 |
| JP | 2001-77609 | 3/2001 |
| JP | 2002-9516 | 1/2002 |

OTHER PUBLICATIONS

Azadegan et al., "Miniaturized Slot-line and Folded Slot Band-pass Filters," 2003 IEEE MTT-S Digest, Jun. 8-13, 2003, pp. 1595-1598.*

U.S. Appl. No. 10/969,096, Kanno et al.

* cited by examiner

*Primary Examiner*—Seungsook Ham
(74) *Attorney, Agent, or Firm*—McDermott Will & Emery LLP

(57) ABSTRACT

Inside a multilayer dielectric substrate, there are a spiral-shaped first slot set in a part of a first ground conductor layer and a spiral-shaped second slot in a part of a second ground conductor layer put on the front surface of the multilayer dielectric substrate, the first slot and the second slot are opposite in a spiral winding direction and the first slot and the second slot overlap with each other as viewed from the top face, so that a resonance phenomenon can be produced at a frequency lower than a resonance frequency of a resonator with a conventional structure.

5 Claims, 17 Drawing Sheets

RESONATOR

REFERENCE TO RELATED APPLICATION

This Application is a continuation of International Application No. PCT/JP2004/015142, whose international filing date is Oct. 14, 2004, which in turn claims the benefit of Japanese Application No. 2003-354817, filed on Oct. 15, 2003, the disclosures of which Applications are incorporated by reference herein. The benefit of the filing and priority dates of the International and Japanese Applications is respectfully requested.

BACKGROUND OF THE INVENTION

The present invention relates to a radio-frequency circuit for transmitting or radiating radio-frequency signals in frequency bands such as a microwave band and a milliwave band, and more particularly to a resonator for producing a resonance phenomenon at a specified design frequency (resonance frequency) in these bands.

In recent years, radio communication equipment with smaller size and higher functionality has been developed, which has allowed explosive growth of radio communication equipment typified by cell-phones and the like. In the future, it is predicted that there will be continuous demands for further downsizing of the radio communication equipment or each device for use in the radio communication equipment without damage on the functionality or the low cost thereof.

One of resonance circuit elements (resonators) for use in the radio-frequency circuit mounted on the radio equipment includes a radio-frequency circuit element using a slot circuit, a part of which is cut off from a ground conductor interconnection layer. For example, an oblong slot circuit can produce a resonance phenomenon at a half wave frequency equivalent to the distance between both the ends of the slot. Further, if a slot portion is disposed in a spiral fashion, the resonance phenomenon can be produced in lower frequency bands, i.e., against longer electromagnetic waves, without increase in space occupancy. For example, as shown in a cross sectional view in FIG. 14A and a top view in FIG. 14B, a resonator 500 has a slot circuit 505 formed in a square region, 2000 microns on a side, in a ground conductor layer 503 formed on the surface of a dielectric substrate 501 with a dielectric constant of 10 and a thickness of 600 microns, the slot circuit 505 being formed into a spiral shape with the turning number of 1.5 times, and the resonator 500 has a resonance frequency of 6.69 GHz.

Moreover, in an example shown in non patent document 1, two slot circuits in the spiral shape with the turning number of 2 to 4.5 times are disposed on the same plane in an axisymmetrical way and are further coupled in series to constitute a slot resonator which resonates at a half frequency of the respective spiral slot circuits and which is applied to part of a filter circuit. In this example, two spiral slot circuits are connected in series and their central portion is coupled with an input circuit so as to establish strong coupling.

[Non Patent Document 1]

"Miniaturized Slot-Line and Folded-Slot Band-Pass Filters", P1595-P1598 of International Microwave Symposium Digest, MTT-S, 2003 IEEE

SUMMARY OF THE INVENTION

However, since further downsizing of such resonators are demanded, the slot circuit which produces resonance at a size that is equivalent to the size of ½ wavelength of an electromagnetic wave suffers such a problem that space occupancy increases in micro wave bands.

As shown in the non patent document 1, although series connection of two slot circuits allows a resonance wavelength to be double and so the resonance frequency can be reduced to ½, disposing the respective slot circuits on the same plane doubles the circuit space occupancy, which is not desirable in view of pursuit of downsizing.

Moreover, since shortening of an effective wavelength in the circuit substrate is also effective for decreasing the resonance frequency, use of high dielectric constant materials is possible, while at the same time, it requires special manufacturing process unlike substrates made of resin materials or general semiconductor substrates, and causes increase in manufacturing costs.

An object of the present invention is to provide, for solving these problems, a resonator which allows generating a resonance phenomenon in frequency bands lower than those of conventional half-wavelength resonators and which allows downsizing and area reduction, as well as volume saving.

In order to accomplish the object, the present invention is constituted as shown below.

According to a first aspect of the present invention, there is provided a resonator for producing a resonance phenomenon at a resonance frequency, comprising:

a dielectric substrate;

a first ground conductor layer having a first slot formed into a spiral shape with a turning number of one time or more, which is disposed on a front surface of the dielectric substrate; and a second ground conductor layer having a second slot formed into a spiral shape with a turning number of one time or more, which is disposed on a back surface of the dielectric substrate, wherein the first slot and the second slot overlap with each other as viewed from a top face.

The phrase "as viewed from a top face" herein refers to the meaning that the first slot and the second slot are transparentized and observed from the front surface side of the dielectric substrate. In other words, it means that the plane (the front surface) including the first slot and the plane (the back surface) including the second slot are virtually moved in horizontal direction so as to be vertical to the front surface of the dielectric substrate (thickness direction of the dielectric substrate) and are viewed in the state of overlapping with each other on the same plane. The term "as viewed from the top face" refers to the same meaning in the following description.

According to a second aspect of the present invention, there is provided the resonator as defined in the first aspect, wherein a winding direction of the first slot and a winding direction of the second slot are opposite to each other.

According to a third aspect of the present invention, there is provided the resonator as defined in the first aspect, wherein the first slot and the second slot are disposed so that, as viewed from the top face, respective spiral centers are aligned with each other and respective outer edges are almost aligned with each other.

According to the fourth aspect of the present invention, there is provided the resonator as defined in the third aspect, in which the first slot and the second slot are disposed such that the outer termination portion of the first slot and an outer termination portion of the second slot are disposed at positions symmetric with respect to a spiral center of the first slot as viewed from the top face.

According to a fifth aspect of the present invention, there is provided the resonator as defined in the first aspect, which produces the resonance phenomenon at the resonance frequency lower than a resonance frequency of the first slot and a resonance frequency of the second slot.

According to a sixth aspect of the present invention, there is provided the resonator as defined in the first aspect, further comprising a connection through conductor disposed so as to go through the dielectric substrate for connecting a ground conductor region outside an outer edge of the first slot in the first ground conductor layer and a ground conductor region outside the second slot in the second ground conductor layer.

According to a seventh aspect of the present invention, there is provided a resonator for producing a resonance phenomenon at a resonance frequency, comprising:

a dielectric substrate;

a ground conductor layer having a slot formed into a spiral shape with a turning number of one time or more, which is disposed on a front surface of the dielectric substrate; and a spiral conductor interconnection disposed on a back surface of the dielectric substrate and formed into a spiral shape with a turning number of one time or more, wherein the slot and the spiral conductor interconnection overlap with each other as viewed from a top face.

As a result, the resonator can produce the resonance phenomenon at the resonance frequency lower than the resonance frequency of the slot and the resonance frequency of the spiral conduction interconnection.

According to an eighth aspect of the present invention, there is provided the resonator as defined in the seventh aspect, wherein a winding direction of the slot and a winding direction of the spiral conductor interconnection are opposite to each other.

According to a ninth aspect of the present invention, there is provided the resonator as defined in the seventh aspect, wherein the slot and the spiral conductor interconnection are disposed so that, as viewed from the top face, respective spiral centers are aligned with each other and respective outer edges are almost aligned with each other.

According to a tenth aspect of the present invention, there is provided the resonator as defined in the ninth aspect, wherein an outer termination portion of the slot and an outer termination portion of the spiral conductor interconnection are disposed at positions symmetric with respect to a spiral center of the slot as viewed from the top face.

According to an eleventh aspect of the present invention, there is provided a resonator for producing a resonance phenomenon at a resonance frequency, comprising:

a dielectric substrate;

a ground conductor layer having a slot formed into a spiral shape with a turning number of one time or more, which is disposed on a front surface of the dielectric substrate;

a spiral conductor interconnection disposed on a back surface of the dielectric substrate and formed into a spiral shape with a turning number of one time or more; and a connection through conductor disposed so as to go through the dielectric substrate for connecting an inner termination portion of the spiral conductor interconnection or a vicinity thereof and a ground conductor region inside the slot in the ground conductor layer, wherein the slot and the spiral conductor interconnection overlap with each other as viewed from a top face.

As a result, the resonator can produce the resonance phenomenon at the resonance frequency lower than the resonance frequency of the slot and the resonance frequency of the spiral conduction interconnection. Particularly, the slot resonator which normally functions only as a half-wave-type resonator can function as a part of a quarter-wave-type resonator having a shorter resonance wave length, which makes it possible to provide a slot resonator which produces the resonance phenomenon at the resonance frequency considerably lower than the conventional resonance frequency.

According to a twelfth aspect of the present invention, there is provided the resonator as defined in the eleventh aspect, wherein the connection through conductor is connected to the ground conductor region in a vicinity of a spiral center of the slot in the ground conductor layer.

According to a thirteenth aspect of the present invention, there is provided the resonator as defined in the eleventh aspect, wherein a winding direction of the slot and a winding direction of the spiral conductor interconnection are opposite to each other.

According to a fourteenth aspect of the present invention, there is provided the resonator as defined in the eleventh aspect, wherein the slot and the spiral conductor interconnection are disposed so that, as viewed from the top face, respective spiral centers are aligned with each other and respective outer edges are almost aligned with each other.

According to a fifteenth aspect of the present invention, there is provided the resonator as defined in the fourteenth aspect, wherein an outer termination portion of the slot and an outer termination portion of the spiral conductor interconnection are disposed at positions symmetric with respect to a spiral center of the slot as viewed from the top face.

According to a sixteenth aspect of the present invention, there is provided a resonator for producing a resonance phenomenon at a resonance frequency, comprising:

a dielectric substrate;

a first ground conductor layer having a slot formed into a spiral shape with a turning number of one time or more, which is disposed on a front surface of the dielectric substrate;

a second ground conductor layer disposed on a back surface of the dielectric substrate;

a spiral conductor interconnection formed in between the front surface and the back surface of the dielectric substrate and formed into a spiral shape with a turning number of one time or more; and a connection through conductor disposed in between the spiral conductor interconnection and the second ground conductor layer so as to go through the dielectric substrate for connecting an inner termination portion of the spiral conductor interconnection or a vicinity thereof and the second ground conductor layer, wherein the slot and the spiral conductor interconnection overlap with each other as viewed from a top face.

As a result, the resonator can produce the resonance phenomenon at the resonance frequency lower than the resonance frequency of the slot and the resonance frequency of the spiral conduction interconnection. Particularly, the slot resonator which normally functions only as a half-wave-type resonator can function as a part of a quarter-wave-type resonator having a shorter resonance wave, which makes it possible to provide a slot resonator which produces the resonance phenomenon at the resonance frequency considerably lower than the conventional resonance frequency.

According to a seventeenth aspect of the present invention, there is provided the resonator as defined in the sixteenth aspect, wherein a winding direction of the slot and a winding direction of the spiral conductor interconnection are opposite to each other.

According to an eighteenth aspect of the present invention, there is provided the resonator as defined in the sixteenth aspect, wherein the slot and the spiral conductor interconnection are disposed so that, as viewed from the top face, respective spiral centers are aligned with each other and respective outer edges are almost aligned with each other.

According to a nineteenth aspect of the present invention, there is provided the resonator as defined in the eighteenth aspect, wherein an outer termination portion of the slot and an outer termination portion of the spiral conductor interconnection are disposed at positions symmetric with respect to a center point of the spiral of the slot as viewed from the top face.

According to the first aspect of the present invention, the first ground conductor layer having the first slot formed into a spiral shape and the second ground conductor layer having the second slot formed also into a spiral shape are disposed on the surface and the back surface of the dielectric substrate, and the first slot and the second slot are disposed so as to overlap as viewed from the top face (i.e., disposed such that there is an overlapped portion in the thickness direction of the dielectric substrate with respective formation positions being different), so that under the conditions that a radio-frequency displacement current flows in the same direction in the respective slots, a so-called even mode can be induced in the overlapped portion of the respective slots, thereby allowing an apparent dielectric constant to be increased. As a result, it becomes possible to decrease the resonance frequency in the resonator structure having the layout structure of the respective slots in the laminated state to be lower than the resonance frequency in the resonator structure in which each slot exists independently. More particularly, it becomes possible to provide a resonator which can produce a resonance phenomenon at a resonance frequency lower than the resonance frequency of the first slot and the resonance frequency of the second slot.

Further, the reduction effect of such a resonance frequency can be increased as the overlapped portion of the respective slots is increased. Thus, the reduction effect of the resonance frequency can be obtained, and this makes it possible to achieve the resonance phenomenon of a half-wave resonance mode with the space occupancy of the conventional one resonator, the half-wave resonance mode having a resonator length longer than the resonator length in the conventional resonator structure having the structure in which, for example, the respective slots adjacently disposed on the same plane are coupled in series, thereby allowing considerable downsizing, area reduction and volume saving of the resonator.

According to another aspect of the present invention, such a reduction effect of the resonance frequency can be enhanced by disposing the slots so that the spiral winding direction of the first slot and the spiral winding direction of the second slot are opposite to each other.

Moreover, the reduction effect of the resonance frequency can be further enhanced by disposing the slots so that the centers and outer edges of the spirals of the respective slots are aligned with each other in the laminating direction.

Further, by disposing the respective slots so that the outer termination portion of the first slot and an outer termination portion of the second slot are disposed at positions symmetric with respect to a center point of the spiral of the slot, the resonator length can be increased and the reduction effect of the resonance frequency can be further enhanced.

Moreover, by further providing the connection through conductor disposed through the dielectric substrate for connecting a ground conductor region outside an outer edge of the first slot and a ground conductor region outside the second slot, the radio-frequency ground state of the respective ground conductor layers can be strengthened. Thus, even if difference in the connection state (mounting state) when the resonator is connected to an external circuit causes difference in the ground state between the first ground conductor layer and the second ground conductor layer, strengthening the ground state allows the potentials of the ground conductor layers to be identical, thereby enabling the characteristics of the resonator to be stabilized.

Moreover, the effects of considerable downsizing, area reduction and volume saving of the resonator according to the first aspect achieved in the resonator having the layout structure of the respective slots in the laminated state may also be achieved in the resonator having the layout structure of the spiral-shaped slot and the spiral-shaped spiral conductor interconnection in the laminated state.

Moreover, by further providing the connection through conductor disposed through the dielectric substrate for connecting an inner termination portion of the spiral conductor interconnection or the vicinity thereof and a region inside the outer edge of the slot in the ground conductor layer, the slot circuit which is originally a half-wave resonator can be functioned as a quarter-wave-type resonator to achieve further downsizing of the resonator, while the cross-coupling capacitance between the slot and the spiral conductor interconnection allows the apparent dielectric constant to be increased in a radio-frequency current in the resonance mode, thereby allowing further reduction of the resonance frequency.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1A:
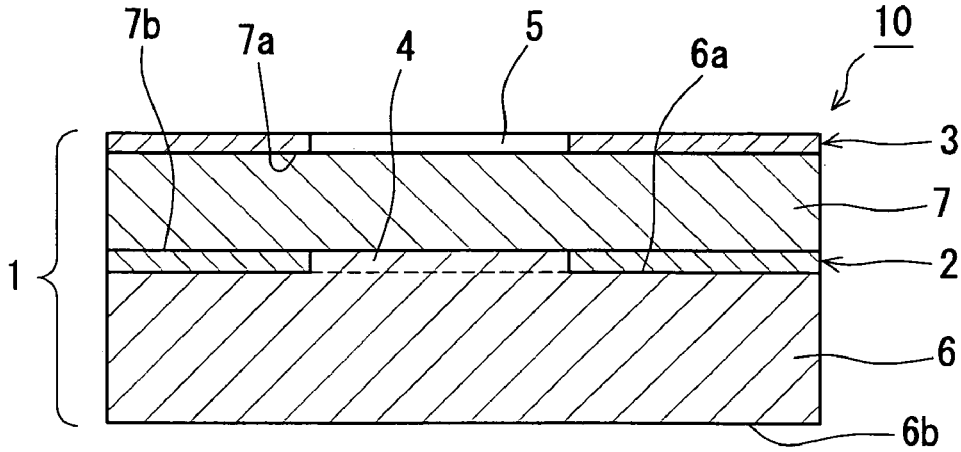
FIG. 1A is a cross sectional view showing a resonator in a first embodiment of the present invention.

Before the description of the present invention proceeds, it is to be noted that like parts are designated by like reference numerals throughout the accompanying drawings.

Hereinbelow, one embodiment of the present invention is described in detail with reference to the accompanying drawings.

(First Embodiment)

FIG. 1A is a cross sectional view showing a resonator 10 using a radio-frequency circuit according to the first embodiment of the present invention.

In FIG. 1, the resonator 10 has a multilayer dielectric substrate 1 having a laminated structure comprises a first dielectric substrate 6 and a second dielectric substrate 7. Moreover, the respective dielectric substrates 6 and 7 are laminated so that a front surface 6*a* (top face in the drawing) of the first dielectric substrate 6 and a back surface 7*b* (bottom face in the drawing) of the second dielectric substrate 7 are bonded to each other, and in this bonding portion, a first ground conductor layer 2 is formed. Moreover, a second ground conductor layer 3 is formed on a front surface 7*a* (top face in the drawing) of the second dielectric substrate 7, i.e., the front surface of the multilayer dielectric substrate 1. It is to be noted that the front surface 6*a* of the first dielectric substrate 6 and the front surface 7*a* of the second dielectric substrate 7 are formed so as to be parallel to each other, while the first ground conductor layer 2 and the second ground conductor layer 3 are disposed parallel to each other.

Figure 1B:
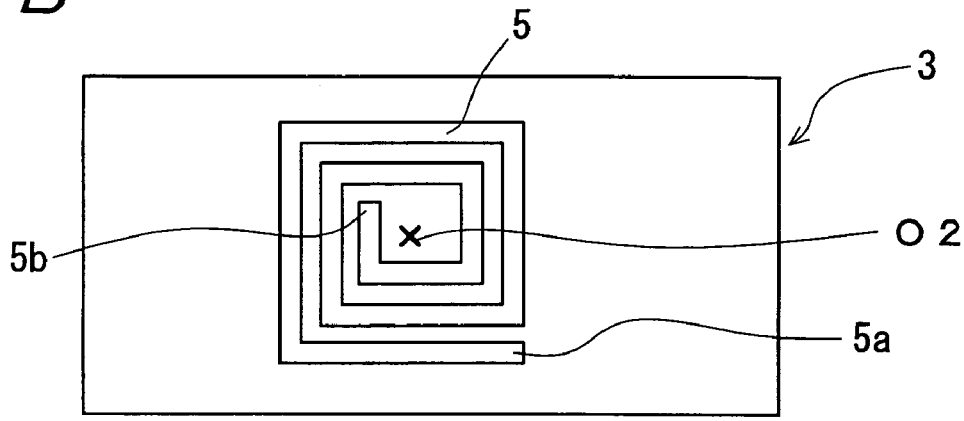
FIG. 1B is a top view showing a second ground conductor layer included in the resonator of FIG. 1A.
Figure 1C:
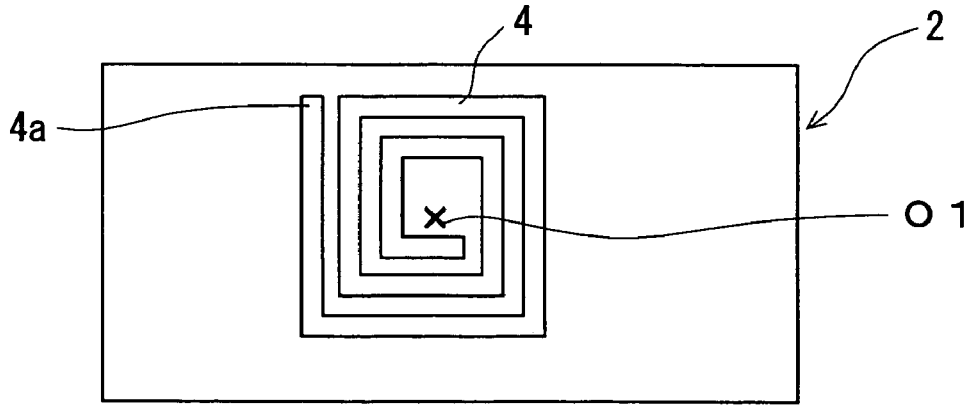
FIG. 1C is a top view showing a first ground conductor layer included in the resonator of FIG. 1A.

Herein, the top view of the second ground conductor layer 3 included in the resonator 10 of FIG. 1A is shown in FIG. 1B and the top view of the first ground conductor layer 2 is shown in FIG. 1C. As shown in FIG. 1C, a first slot 4 whose conductor portion is removed in a spiral shape so as to go through its conductor layer in the thickness direction is formed in the first ground conductor layer 2. Also as shown in FIG. 1B, a second slot 5 whose conductor portion is removed in a spiral shape so as to go through its conductor layer in a thickness direction is formed in the second ground conductor layer 3. The first slot 4 and the second slot 5 are each formed in, for example, a square shape whose outer edge is equal in size, and are each formed into, for example, a spiral shape so as to have an identical groove width, an identical interval pitch between adjacent grooves and an identical turning number of the spiral.

Moreover, in FIG. 1A, a resonance frequency, which is obtained in the case where a resonator structure excluding the second ground conductor layer 3 and including only the first slot 4 is employed, is assumed to be f1, whereas a resonance frequency, which is obtained in the case where a resonator structure excluding the first ground conductor layer 2 and including only the second slot 5 is employed, is assumed to be f2. The relationship between the resonance frequencies f1 and f2 obtained in the case where the respective slots 4 and 5 exist independently is $f1<f2$ due to difference in dielectric constant distribution around the slots 4 and 5.

Moreover, as shown in FIG. 1A, FIG. 1B and FIG. 1C, the first slot 4 and the second slot 5 are disposed so that a spiral center O1 of the first slot 4 and a spiral center O2 of the second slot 5 are aligned with each other as viewed from a laminated direction of the respective dielectric substrates 6 and 7. Further, the slots 4 and 5 are disposed so that the outer edges of the respective square shapes of the first slot 4 and the second slot 5 (outer edges of slot formation regions in the respective ground conductor layers) are almost aligned with each other.

By disposing the first slot 4 and the first dielectric substrate 6 in this way in the resonator 10, the 4 and the second slot 5 have an overlapped portion in the laminated direction (the thickness direction or a height direction) of the respective dielectric substrates 6 and 7 with the positions in the laminated direction being different from each other. More particularly, the first slot 4 and the second slot 5 have a portion overlapping with each other as viewed from the top face (in the case as viewed from the laminated direction). In the present specification, such overlap is defined as "cross coupling", and the capacitance generated by such cross coupling is defined as "cross coupling capacitance".

Further, with stronger cross coupling of both the slots 4 and 5, a resonance frequency f0 in the resonator 10 can be reduced more so that, for example, the resonance frequency f0 in a resonator structure having the layout structure of both the slots 4 and 5 in the laminated direction can be smaller than a value of ½ of the resonance frequency f1 in a resonator structure having only the slot 4. More particularly, among the resonance frequency f0 of the resonator 10 having the layout structure of both the slots 4 and 5 in the laminated direction, the resonance frequency f1 in the resonator structure including only the first slot 4 and the resonance frequency f2 in the resonator structure including only the second slot 5, the relationship as shown in Equation (1) is satisfied.

(Equation 1)

$$f0<f1<f2 \quad (1)$$

Therefore, in the resonator 10 in the first embodiment, the resonance phenomenon of a half-wave resonance mode having a resonator length longer than the resonator length in the conventional resonator having the structure in which the respective slots adjacently disposed on the same plane are coupled in series can be obtained with the space occupancy of the conventional one resonator. It is to be noted that such a resonance frequency f0 becomes a design frequency in the resonator 10, and the resonator 10 can produce the resonance phenomenon at the design frequency.

By employing the layout structure establishing such cross coupling, under the conditions that a radio-frequency displacement current flows in the same direction in the respective slots 4 and 5, a so-called even mode is induced in each portion where cross coupling is established in both the slots 4 and 5, thereby allowing an apparent dielectric constant to be increased. For effective increase of the apparent dielectric constant, the outermost portions of both the slots 4 and 5 in particular should preferably be cross-coupled over a wider area. Therefore, the slots 4 and 5 are formed so as to have identical groove width, interval pitch of the grooves and turning number, and the slots 4 and 5 are also disposed so that the centers and the outer edges of the respective spirals are aligned with each other, by which the cross coupling over a wide area can be realized and so this layout becomes a preferably form.

Moreover, the effect of the resonance frequency reduction in the resonator structure in the first embodiment is attributed to generation of a radio-frequency current flowing in the same direction in the respective portions of the top and bottom slots 4 and 5 with the cross coupling established. More specifically, the resonance frequency of the resonator depends on an effective length of the portions between which a radio-frequency current is reflected in the resonance mode, i.e., depends on an effective resonator length. In the resonator 10 in the first embodiment, a radio-frequency current in the resonance mode induces the radio-frequency current flowing in the same direction in the top and bottom slots 4 and 5, so that the radio-frequency current can move through the cross-coupling capacitance between the top and bottom slots 4 and 5. The higher the frequency current becomes, the more current the cross-coupling capacitance can move, whereas the lower the frequency current becomes, the more the movable current amount decreases. Consequently, for producing the resonance phenomenon at a lower frequency in the resonator 10, there are, for example, three methods.

The first method is to set the effective resonator lengths of the first slot and the second slot long enough for the resonance phenomenon to be produced at a sufficiently low resonance frequency with absolutely no intermediation by the cross-coupling capacitance. This method is a conventional technique to reduce the resonance frequency and therefore is not included in the claims of the present invention.

Next, the second method is to gain a long effective resonator length by the radio-frequency current moving between the top and bottom slots 4 and 5 repeatedly in the resonance mode. For this method, it is effective to reduce an interval at which the first slot 4 and the second slot 5 are laminated. Such a method is applicable to the resonator 10 in the first embodiment.

The third method is to set the effective resonator length to be longest in the case where the radio-frequency current moves between the top and bottom slots 4 and 5 in between the first slot 4 and the second slot 5 for an extremely small number of times, e.g., 1 or 2 times. For this method, it is necessary to optimize the layout conditions of the first slot 4 and the second slot 5. More specific description will be given of such optimization of the relative layout conditions of both the slots with reference to the drawings.

Figure 2A:
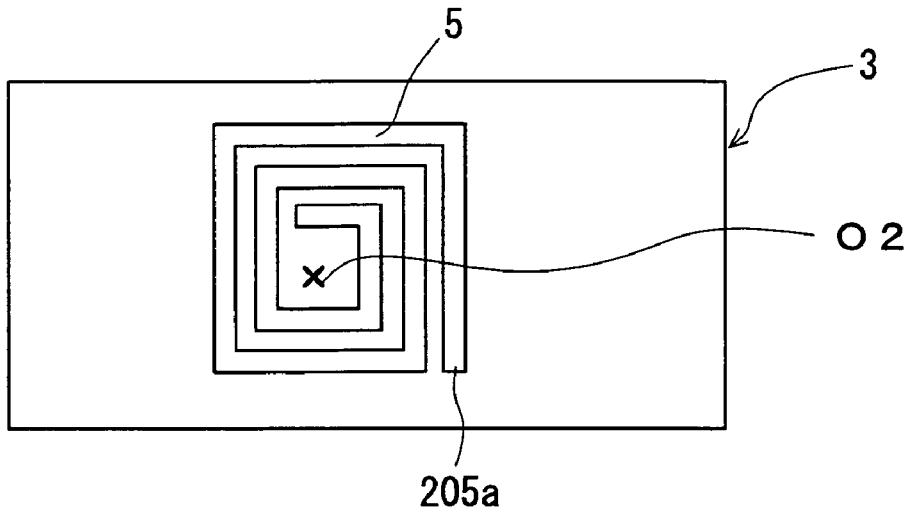
FIG. 2A is a view showing a layout example of the spiral shape of the slots formed in the respective ground conductor layers and showing the layout of the second slot.
Figure 2B:
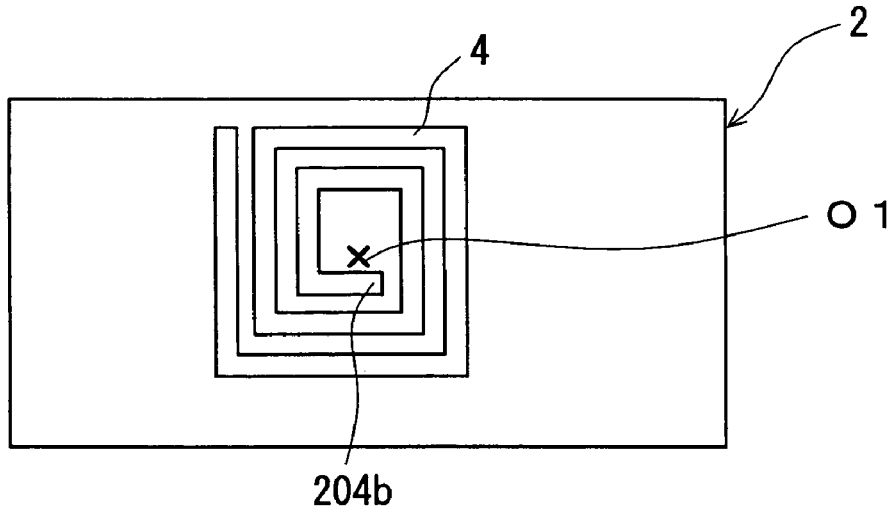
FIG. 2B is a view showing a layout of the first slot.
Figure 3A:
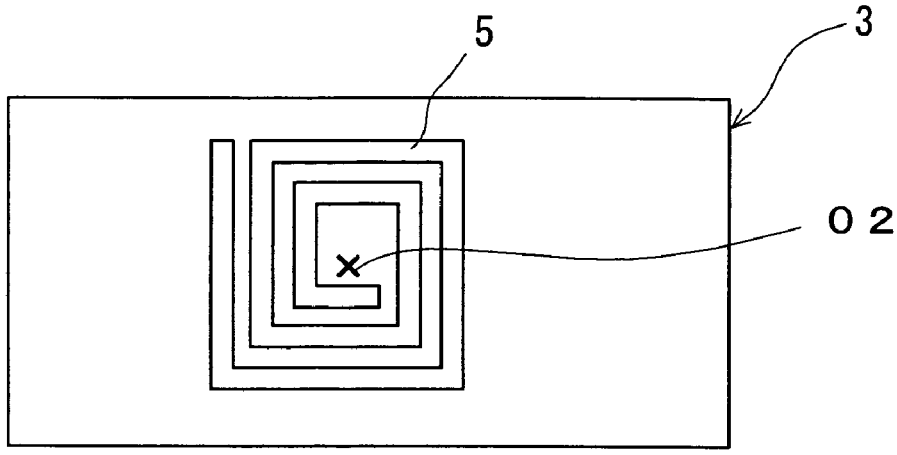
FIG. 3A is a view showing another layout example of the spiral shape of the slots formed in the respective ground conductor layers and showing the layout of the second slot.
Figure 3B:
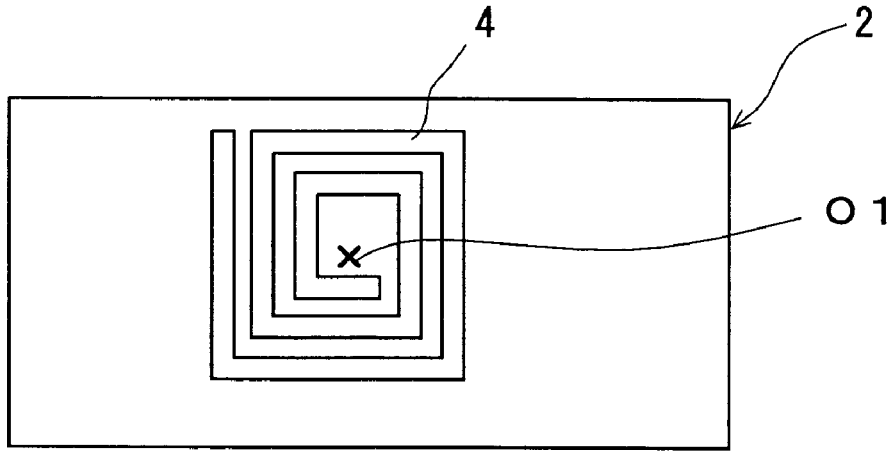
FIG. 3B is a view showing a layout of the first slot.

First, description is given of the case where, unlike FIG. 1B and FIG. 1C, the winding direction of the spiral shape of both the slots 4 and 5 is identical and the turning number of the spirals of both the slots 4 and 5 is identical. Relative angles to dispose both the slots 4 and 5 under these conditions have a plurality of combinations including the combination in which the second slot 5 is disposed in the state of being relatively rotated 180 degrees with respect to the first slot 4 as shown in FIG. 2A and FIG. 2B and the combination in which the second slot 5 is disposed so as to completely overlap with the first slot 4 as shown in FIG. 3A and FIG. 3B. Among these two layout patterns, lower resonance frequency can be obtained in the case where the two slots 4 and 5 are disposed in the state of being rotated 180 degrees as shown in FIG. 2A and FIG. 2B than in the case where the two slots 4 and 5 are disposed in the total alignment as shown in FIG. 3A and FIG. 3B.

For example, in the layout pattern as shown in FIG. 3A and FIG. 3B, even if the radio-frequency current flowing in the first slot 4 moves to the second slot 5 via the cross-coupling capacitance and flows in the same direction, it is not possible to make the effective resonator length much longer than the first slot 4. The resonance frequency in this case is fs0. In the layout pattern as shown in FIG. 2A and FIG. 2B, when the radio-frequency current flowing in the first slot 4 moves to the second slot 5 through the cross-coupling capacitance and flows in the same direction, the effective resonance length is increased. If the resonance frequency in this case is fs180, then the relationship between the respective resonance frequencies is expressed in Equation (2).

(Equation 2)

$$fs180<fs0<f1<f2 \quad (2)$$

Such geometrical understanding indicates that in the case where the spiral winding direction of the first slot 4 and the second slot 5 in the resonator of the first embodiment is set to be identical direction, the lowest resonance frequency is given by the setting in which an outer termination portion 4*a* of the first slot 4 and an outer termination portion 5*a* of the second slot 5 are disposed at positions almost symmetric with respect to a center point O1 of the spiral of the first slot 4.

Further, such layout pattern combinations of both the slots 4 and 5 are similarly formulated with the first slot 4 and the second slot 5 being opposite to each other in the winding direction as shown in FIG. 1B and FIG. 1C, and among those combinations, the case in which the respective slots 4 and 5 are disposed in the state of being rotated 180 degrees is preferable. More particularly, it is preferable in view of obtaining a lower frequency that the outer termination portion 4*a* of the first slot 4 and the outer termination portion 5*a* of the second slot 5 are disposed at positions almost symmetric with respect to a center point O1 of the spiral of the first slot 4.

Moreover, as shown in FIG. 1B and FIG. 1C, it is preferable that the respective slots 4 and 5 are disposed so that the winding direction of the first slot 4 and the winding direction of the second slot 5 are opposite to each other. More particularly, in the mode where a radio-frequency displacement current flows between the two slots 4 and 5 connected via cross coupling so as to rotate the spirals in the same direction, increase in the resonator length can be obtained most effectively in the case where the winding direction of the respective slots 4 and 5 is opposite compared to the case where their winding direction is the same direction, and as a result, effective reduction of the resonance frequency f0 in the resonator 10 can be achieved.

The reason will be described in detail below. First, in the case where the spiral winding direction of the first slot 4 and the second slot 5 is identical like the resonator having the layout pattern as shown in FIG. 2A and FIG. 2B, the radio-frequency current flowing in the first slot 4 in the resonance mode moves to the second slot 5 via the cross-coupling capacitance while keeping the same flowing direction and receives reflection in the terminal portion of the second slot 5. For example, assuming that an outer termination portion 205*a* of the second slot is one termination point of the resonator, an inner termination portion 204B of the first slot 4 is the other termination point of the resonator and the effective distance between both the termination points becomes an effective resonator length of the resonator.

Even in the case of setting the spiral winding direction of the first slot 4 and the second slot 5 to be opposite to each other like the resonator 10 in the first embodiment having the layout pattern as shown in FIG. 1B and FIG. 1C, there are no changes regarding the point that the radio-frequency current flowing in the first slot 4 in the resonance mode moves to the second slot 5 via the cross-coupling capacitance while keeping the same flowing direction and receives reflection in the terminal portion of the second slot 5. However, if it is assumed, for example, that the outer termination portion 5*a* of the second slot 5 is one termination point of the resonator 10, then the radio-frequency current flows to an inner termination portion 5*b* of the second slot 5 before being reflected by the inner termination portion 5*b*, and the radio-frequency current moves to the inside of the first slot 4 via the cross-coupling capacitance before being terminated in the outer termination portion 4*a* of the first slot 4. Consequently, by setting the spiral winding direction of the first slot 4 and the second slot 5 to be opposite to each other, the effective resonator length defined by the outer termination portion 4*a* of the first slot 4 and the outer termination portion 5*a* of the second slot 5 becomes geometrically longer than that in the case of setting the spiral winding direction of the first slot 4 and the second slot 5 to be identical. Therefore, disposing both the slots 4 and 5 so as to be opposite in the winding direction enables the resonance phenomenon to be produced at a lower resonance frequency. More particularly, the relationship between the resonance frequency fo in the case of setting the first slot 4 and the second slot 5 to be opposite in the spiral winding direction and the respective resonance frequencies can be expressed in Equation (3) and it is proved that the resonance frequency fo is the lowest value.

(Equation 3)

$$fo<fs180<fs0<f1<f2 \quad (3)$$

It is to be noted that the respective resonance frequencies fo, f180 and fs0 in the first embodiment are examples of the resonance frequency f0 and are included in the resonance frequency f0.

Although in the resonator 10 in the first embodiment, description has been given of the resonator structure including the first slot 4 and the second slot 5 in the spiral shape formed in the state of being laminated, the same effects can be achieved when the number of spiral-shaped slots to be laminated is expanded to 3 or more. Particularly, by disposing the respective spiral-shaped slots disposed in the laminated direction so that their formation regions overlap, the cross coupling may be strengthened and further, by setting the combination of the respective slots which are adjacently disposed in the laminated direction to be opposite to each other in the spiral winding direction, it becomes possible to produce the resonance phenomenon at the lowest resonance frequency.

While it is possible with use of flat circuits to adjacently dispose two slot circuits and couple them via capacitance, it is necessary for achieving a strong degree of coupling to drastically decrease an interval distance between these two slot circuits, which is extremely difficult to realize in general manufacturing process. Moreover, in the case where the slot circuits are disposed adjacently on the plane, only a part of the respective slot circuits can be coupled with each other, thereby hindering achievement of a high degree of coupling.

In the resonator structure included in the resonator 10 in the first embodiment, not only the cross coupling is achieved over almost the entire surfaces of the two slots 4 and 5, but also the degree of coupling can be enhanced by decreasing the laminating interval between the first ground conductor layer 2 and the second ground conductor layer 3. Consequently, it becomes possible to set the increase of the apparent dielectric constant induced by an even mode to be high, thereby allowing effective reduction of a circuit area. Therefore, in the range in which decrease of a resonance value Q caused by increase of a loss can be overcome, or in the range allowing margins in the manufacturing process, the laminating interval between the first ground conductor layer 2 and the second ground conductor layer 3 in the resonator 10 in the first embodiment should preferably be set small. For example, it is preferable to set the laminating interval in the range of 0.5 μm to 500 μm. In the case where the resonator is used for semiconductor application, it is preferable to set the laminating interval in the range of 0.5 μm to 10 μm, and in the case where the resonator is used for printed board application, it is preferable to set the laminating interval to be set in the range of 30 μm to 500 μm.

Although in the resonator 10 in the first embodiment, description has been given of the case where a ground conductor layer is not formed on a back surface 6*b* (bottom face in FIG. 1A) of the first dielectric substrate 6, the first embodiment is not limited to the case. Instead of this case, it is also acceptable to form a third ground conductor layer on almost the entire back surface 6*b* of the first dielectric substrate 6.

Figure 4A:
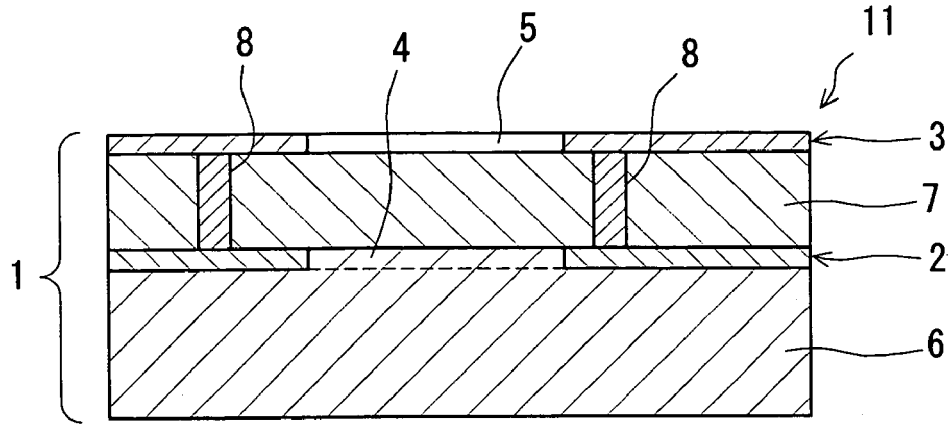
FIG. 4A is a cross sectional view showing a resonator in a modified example of the first embodiment.
Figure 4B:
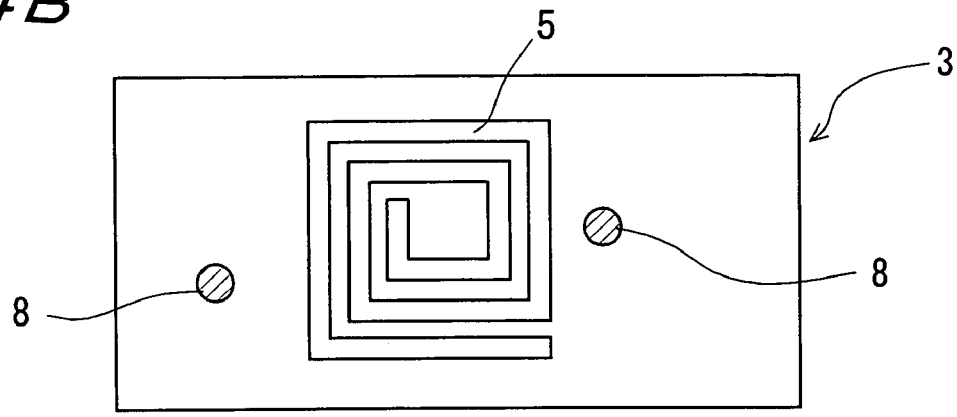
FIG. 4B is a top view showing a second ground conductor layer included in the resonator of FIG. 4A.
Figure 4C:
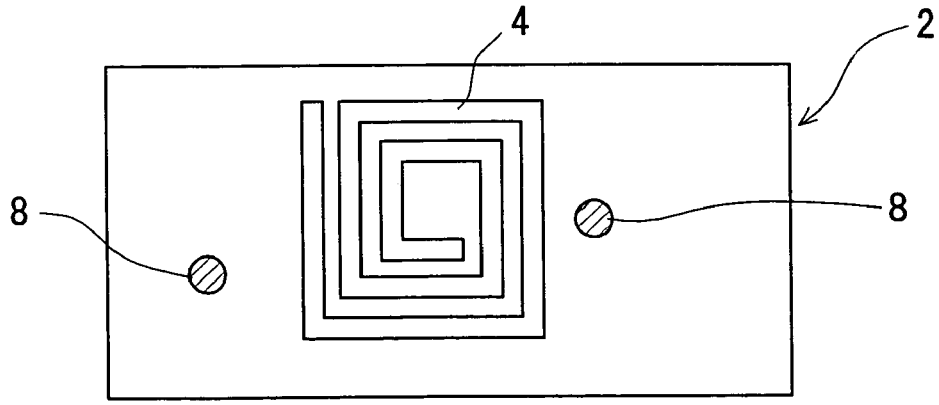
FIG. 4C is a top view showing a first ground conductor layer included in the resonator of FIG. 4A.

Moreover, the first embodiment is not limited to the thus-described structure and is applicable to other various aspects. Herein a resonator 11 according to a modified example of the first embodiment will be described with reference to the drawings. The cross sectional view of such a resonator 11 is shown in FIG. 4A, the top view of a second ground conductor layer 3 included in a resonator 20 is shown in FIG. 4B, and the top view of a first ground conductor layer 2 is shown in FIG. 4C. It is to be noted that regarding-respective component parts included in the resonator 11, the parts having the same structure as the component parts included in the resonator 10 are designated by the same reference numerals.

As shown in FIG. 4A, FIG. 4B and FIG. 4C, the resonator 11 has the same structure as the resonator 10 except the point that a plurality of connection through conductors 8 for electrically connecting the first ground conductor layer 2 and the second ground conductor layer 3 are present. More specifically, in the multilayer dielectric substrate 1, the first ground conductor layer 2 and the second ground conductor layer 3 are connected to each other so that a plurality of connection through conductors 8, e.g., two connection through conductors 8, which are disposed so as to go through the second dielectric substrate 7 disposed between the first ground conductor layer 2 and the second ground conductor layer 3 in the thickness direction. Thus, by connecting the respective ground conductor layers 2 and 3 via the respective connection through conductors 8, the radio-frequency earth state in the respective ground conductor layers 2 and 3 can be strengthened. Thus, even if difference in the mounting method when the resonator 11 is mounted on a radio-frequency circuit on another circuit substrate for example causes difference in the ground state in the ground conductor layer, strengthening the radio-frequency ground state allows the potentials of the respective ground conductor layers to be identical, thereby enabling the characteristics of the resonator 11 to be stabilized.

Moreover, as shown in FIG. 4B and FIG. 4C, the respective connection through conductors 8 formed in this way should preferably be disposed so as to connect a region outside the outer edge (outer edge of an almost square shape formation region) of the first slot 4 in the first ground conductor layer 2 and an region outside the outer edge of the second slot 5 in the second ground conductor layer 3 to each other. More particularly, it is not preferable to dispose the respective connection through conductors 8 so as to be connected to a region inside the outer edge of the first slot 4 in the first ground conductor layer 2 or to a region inside the outer edge of the second slot 5 in the second ground conductor layer 3.

In the slot resonator, the phase of a radio-frequency current rotates along the length direction of the slot, and the resonance phenomenon can be produced at a frequency equivalent to the phase rotation of a half wave, i.e., the phase rotation of 180 degrees. More particularly, the phases in the inside region and the outside region of the spiral-shaped slot formation region should be rotated. However, if the insides of the formation regions of two laminated first slot 4 and the second slot 5 are connected, all the locations including the inside region and the outside region of the first slot 4 formation region as well as the inside region and the outside region of the second slot 5 formation region are put into a stable ground state where the phases are all unified. More particularly, both the first slot 4 and the second slot 5 operate separately without being coupled with each other as the first slot 4 operates as a half-wave resonator with termination potions of both the ends (i.e., the inner termination portion and the outer termination portion) being grounded and the second slot 5 operates as a half-wave resonator with termination potions of both the ends (i.e., the inner termination portion and the outer termination portion) being grounded, and therefore such layout of the connection through conductors as to connect the inside regions of the slot formation regions is not within the claims of the present invention. More particularly, in the resonator 11 in the modified example of the first embodiment, as shown in FIG. 4A, FIG. 4B and FIG. 4C, the respective connection through conductors 8 should preferably be disposed through the second dielectric substrate 7 so as to connect the outside region of the first slot 4 formation region and the outside region of the second slot 5 formation region.

Moreover, among this kind of layout of the respective connection through conductors 8, the layout in which respective connection locations are disposed on a center line which divides the almost square-shape formation regions of the slots 4 and 5 into halves and the layout in which respective connection locations are disposed on an extension of the diagonal line of the almost square-shaped formation regions are preferable in view of stabilizing the ground state of the two ground conductor layers 2 and 3.

WORKING EXAMPLE 1

Next, working examples 1-1 to 1-7 of the resonator in the first embodiment will be described. For the purpose of comparing the structure and the resonance frequency of working examples with those of comparative examples, the working examples 1-1 are shown in Table 1 while the working examples 1-7 are shown in Table 2.

TABLE 1

| | First slot | Second slot | Additional resin substrate thickness (μm) | Spiral winding direction of two slots | Overlap of two slots | Connection of ground conductor layer | Resonance frequency (GHz) |
|---|---|---|---|---|---|---|---|
| Working example 1-1 | Present | Present | 130 | Opposite | — | — | 1.88 |
| Working example 1-2 | Present | Present | 80 | Opposite | — | — | 1.48 |
| Working example 1-3 | Present | Present | 30 | Opposite | — | — | 0.81 |

TABLE 1-continued

| | First slot | Second slot | Additional resin substrate thickness (μm) | Spiral winding direction of two slots | Overlap of two slots | Connection of ground conductor layer | Resonance frequency (GHz) |
|---|---|---|---|---|---|---|---|
| Working example 1-4 | Present | Present | 130 | Identical | Overlapped | — | 3.13 |
| Working example 1-5 | Present | Present | 130 | Identical | Not overlapped (180-degree rotation) | — | 2.69 |
| Working example 1-6 | Present | Present | 130 | Opposite | — | Connected in vicinity of slot | 1.91 |
| Comparative example 1-1 | Present | Absent | 130 | — | — | — | 4.10 |
| Comparative example 1-2 | Absent | Present | 130 | — | — | — | 5.07 |
| Comparative example 1-3 | Present | Present | 130 | Opposite | — | Connected in slot center | 5.21 |

TABLE 2

| | Laminate number of slot circuits | Resonance frequency (GHz) |
|---|---|---|
| Working example 1-1 | 2 | 1.88 |
| Working example 1-7 | 3 | 1.54 |
| Comparative example 1-1 | 1 | 4.10 |

As the working example 1-1 in the first embodiment, a resin substrate with a dielectric constant of 10.2 and a thickness of 640 μm was used as a base substrate (first dielectric substrate 6), a resin substrate (second dielectric substrate 7) with a dielectric constant 10.2 and a thickness of 130 μm was further bonded to the front surface of the base substrate to form a multilayer dielectric substrate 1, and on the multilayer dielectric substrate 1, a radio-frequency circuit based on the conditions as shown in the working example 1-1 in Table 1 was manufactured.

More specifically, a copper interconnection with a thickness of 20 μm was formed as a first ground conductor layer 2 in between the base substrate and the resin substrate inside the multilayer dielectric substrate 1. Moreover, a copper interconnection with a thickness of 20 μm was also formed as a second ground conductor layer 3 on the front surface of the multilayer dielectric substrate 1, i.e., the front surface of the resin substrate. In the first ground conductor layer 2 and the second ground conductor layer 3, spiral-shape first slot 4 and second slot 5 having outer edges of square shapes, 2000 μm on a side as viewed from the outside were formed. Each of the slots 4 and 5 were formed by removing desired portions in the first ground conductor layer 2 and the second ground conductor layer 3 by wet etching and by forming through grooves which go through the conductor layers in the thickness direction. A minimum interconnection width (groove width) and a minimum interval distance between interconnections (groove interval) in the respective slots 4 and 5 were each set at 200 μm. The spiral turning number of both the spiral shapes was set at 2 times. The spiral winding directions of the first slot 4 and the second slot 5 were set to be opposite to each other. The resonator according to the thus-structured working example 1-1 produced the resonance phenomenon at a frequency of 1.88 GHz.

A resonator in the comparative example 1-1 as a comparative example for the working example 1-1, in which a second slot was not formed in the second ground conductor layer and only a first slot was formed in the first ground conductor layer, presented a resonance frequency of 4.10 GHz. Further, a resonator in the comparative example 1-2, in which a first slot was not formed in the first ground conductor layer and only a second slot was formed in the second ground conductor layer, presented a resonance frequency of 5.07 GHz. Such results prove that the resonator in the working example 1-1 offers the resonance phenomenon at a lower frequency compared to either of the comparative examples.

Moreover, a resonator in the working example 1-2, in which a resin substrate (second dielectric substrate 7) additionally bonded onto the base substrate (first dielectric substrate 6) had a thickness reduced from the thickness of 130 μm set in the working example 1-1 to 80 μm, presented a resonance frequency of 1.48 GHz. Moreover, a resonator in the working example 1-3, in which a resin substrate additionally bonded onto the front surface of the base substrate had a thickness further reduced to 30 μm, could present a resonance frequency as low as 0.81 GHz.

The resonance frequency in the resonator in the working example 1-1 took a value smaller than ½ of resonance frequency values in the comparative example 1-1 and the comparative example 1-2, and further the resonance frequency in the resonator in the working example 1-3 took a value smaller than ¼ of resonance frequency values in the comparative example 1-1 and the comparative example 1-2, and therefore it can be said that the resonator in the first embodiment can obtain further more beneficial effects compared to the conventional resonator structured such that two slot circuits are adjacently disposed on the same plane and connected in series.

Moreover, a resonator in the working example 1-4, in which under almost the same conditions as those of the working example 1-1 and with the layout as shown in FIG. 3A and FIG. 3B, the spiral winding directions of the first slot 4 and the second slot 5 were identical and the spiral shapes of the first slot 4 and the second slot 5 were disposed so as to almost overlap with each other, presented a resonance frequency of 3.13 GHz. The resonator in the working example 1-4, though not as good as the working example 1-1, could produce the resonance phenomenon at the resonance frequency lower than that of the resonators in the comparative example 1-2 and the comparative example 1-2.

Moreover, a resonator in the working example 1-5, in which with the layout as shown in FIG. 2A and FIG. 2B, the first slot 4 and the second slot 5 in the working example 1-4 were rotated 180 degrees with the centers O1 and O2 of the spirals of both the slots as rotational axis, presented a resonance frequency of 2.69 GHz, and therefore could provide the resonance phenomenon at the resonance frequency lower than those of the comparative example 1-1, the comparative example 1-2 and further the working example 1-4.

Moreover, in the case where the turning number of the spiral shape was changed in the range of 1 to 2.5 times with the size of the spiral-shaped slot being unchanged, as well as in the case where the formation region of the spiral-shaped slot was further expanded and the turning number of the spiral shape was increased in the range of 2.5 to 5 times, the reduction effect of the resonance frequency was obtained as with the case of the working example 1-1.

Further, in the case where the turning number of two spiral shapes was set at different values, e.g., the turning number of the spiral shape of the first slot 4 was 3 times and the turning number of the spiral shape of the second slot 5 was 1.25 times, the effect was obtained. It is to be noted, however, that more remarkable effect was observed when the spiral shapes of the first slot 4 and the second slot 5 were identical in the turning number than when they were different in the turning number from each other.

Moreover, when the outer shape of the spiral shape was processed to take a shape other than the square, such as polygons and rounds, in the case where the slot widths of the first slot 4 and the second slot 5 were separately reduced from 200 μm to 100 μm and 50 μm, as well as in the case where they were increased to 250 μm and 300 μm, the beneficial effect that the resonance frequency could be reduced could be obtained as with the case of the working example 1-1.

Moreover, in a resonator in the working example 1-6, under the same conditions as those of the working example 1-1, 16 units of connection through conductors 8 with a diameter of 200 μm for connecting the first ground conductor layer 2 and the second ground conductor layer 3 were disposed at intervals of 600 μm on the boundary lines of square shaped-regions, 2400 μm on a side, each positioned 200 μm outward from square-shaped regions, 2000 μm on a side, which were the formation regions of the first slot 4 and the second slot 5. In the resonator in the working example 1-6, the resonance frequency was 1.91 GHz, slightly larger than the resonance frequency of the working example 1-1, and therefore the beneficial effect of the first embodiment was reduced, though connecting the respective ground conductor layers 2 and 3 unified the potentials of both the ground conductor layers 2 and 3, thereby making it possible to obtain the effective effect of strengthening radio-frequency ground, i.e., allowing provision of the resonator which undergoes small characteristic changes as mounting conditions change.

Moreover, a resonator in the working example 1-7 was manufactured by further bonding an additional substrate with a thickness of 130 μm and a dielectric constant 10.2 to the resonator in the working example 1-1. Whereas in the working example 1-1, the resonator had a structure in which two spiral-shaped slots were disposed in the laminated state, the number of laminated spiral-shaped lots was expanded to 3 in the working example 1-7. More particularly, the additional substrate (third dielectric substrate) was laminated on the front surface of the resin substrate via the second ground conductor layer 3, and further the additional ground conductor layer (third ground conductor layer) was provided on the front surface of the additional substrate to form a third slot in the ground conductor layer. In the working example 1-7, the winding directions of the spiral shapes of the third slots and the first slot 4 were set identical and were set different from the winding direction of the spiral of the second slot 5 disposed therebetween, which made it possible to set the entire cross-coupled resonator structure to have the longest resonator length, and the resonance phenomenon could be produced at a frequency of 1.54 GHz which was lower than that of the comparative example 1-1 and the working example 1-1.

In the comparative example 1-3, in a resonator having a structure having the same conditions as those of the working example 1-1, one connection through conductor with a diameter of 200 μm for connecting the first ground conductor layer and the second ground conductor layer was additionally disposed at a center point in the square regions, 2000 μm on a side, which were the spiral-shaped formation regions of the first slot and the second slot. In the resonator in the comparative example 1-3, the resonance frequency was 5.21 GHz, which was larger than the resonance frequencies of the resonators in the comparative example 1-1 and the comparative example 1-2, and therefore such beneficial effect as in the resonator in the first embodiment could not be achieved.

(Second Embodiment)

Figure 5A:
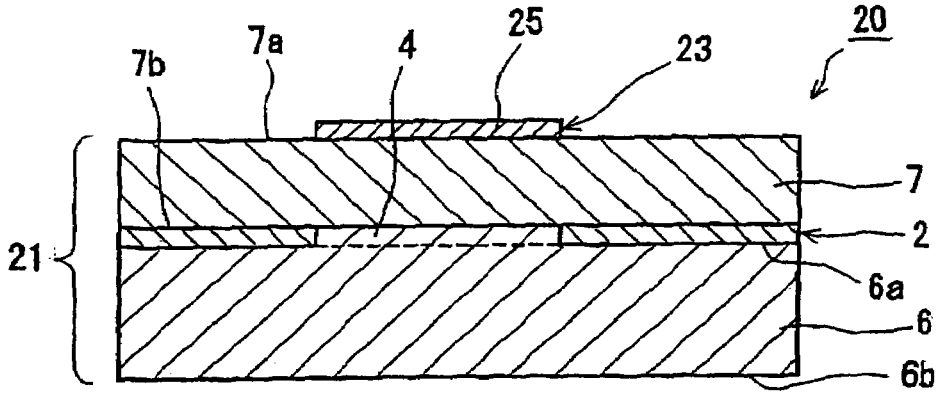
FIG. 5A is a cross sectional view showing a resonator in a second embodiment of the present invention.

It is to be understood that the present invention is not limited to the above embodiment and can be embodied in other various aspects. For example, the cross sectional view showing a structure of a resonator 20 according to the second embodiment of the present invention is shown in FIG. 5A. It is to be noted that in FIG. 5A, component parts same as in FIG. 1A, FIG. 1B and FIG. 1C are designated by the same reference numerals and the description thereof is omitted.

As shown in FIG. 5A, a multilayer dielectric substrate 21 is structured from a laminated structure composed of a first dielectric substrate 6 and a second dielectric substrate 7. In a bonding portion between a front surface 6*a* of the first dielectric substrate 6 and a back surface 7*b* of the second dielectric substrate 7, a ground conductor layer 2 (that is equivalent to the first ground conductor layer 2 in the first embodiment) is formed. Moreover, a conductor interconnection layer 23 is formed on the front surface 7*a* of the second dielectric substrate 7, i.e., on the front surface of the multilayer dielectric substrate 21.

Figure 5B:
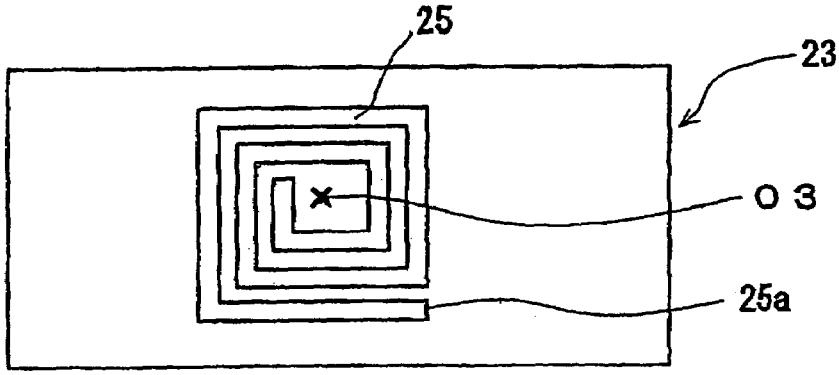
FIG. 5B is a top view showing a ground conductor layer included in the resonator of FIG. 5A.
Figure 5C:
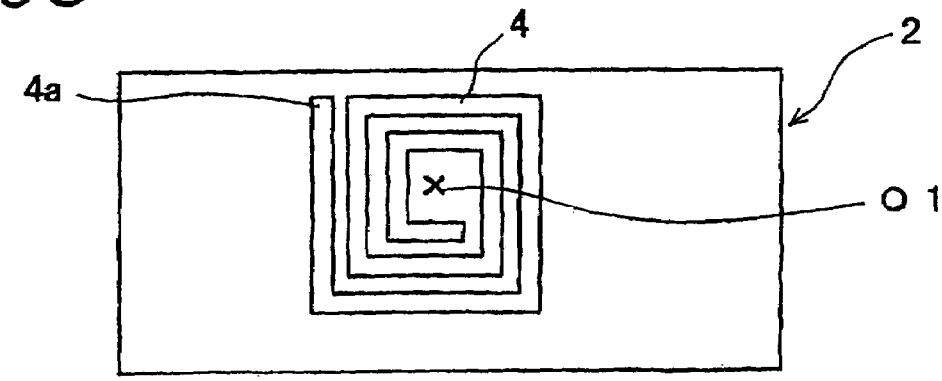
FIG. 5C is a top view showing a ground conductor layer included in the resonator of FIG. 5A.

Herein, the top view of the conductor interconnection layer 23 included in the resonator 20 of FIG. 5A is shown in FIG. 5B and the top view of a ground conductor layer 2 is shown in FIG. 5C. Moreover, as shown in FIG. 5C, in a part of the ground conductor layer 2, a spiral-shaped slot 4 (that is equivalent to the first slot 4 in the first embodiment) is formed. Moreover, as shown in FIG. 5B, in the conductor interconnection layer 23, a spiral-shaped spiral conductor interconnection 25 is formed. The slot 4 and the spiral conductor interconnection 25 are each formed in, for example, a square shape region, which is formed into a spiral shape having an identical groove width, an identical minimum width between interconnections and an identical turning number of the spiral.

Moreover, as shown in FIG. 5B and FIG. 5C, the slot 4 and the spiral conductor interconnection 25 are disposed so that a spiral center O1 of the slot 4 and a spiral center O3 of the spiral conductor interconnection 25 are aligned with each other as viewed from the laminated direction of the respective dielectric substrates 6 and 7. Further, the slot 4 and the spiral conductor interconnection 25 are disposed so that the outer edges of the formation regions of the square shapes of the slot 4 and the spiral conductor interconnection 25 are also almost aligned with each other.

Moreover, in FIG. 5A, a resonance frequency, which is obtained in the case where a resonator structure excluding the spiral conductor interconnection 25 and including only the slot 4 is employed, is assumed to be f1, whereas a resonance frequency, which is obtained in the case where a resonator structure excluding the slot 4 and including only the spiral conductor interconnection 25 is employed, is assumed to be f3. The relationship between the resonance frequencies f1 and f3 obtained in the case where the slot 4 or the spiral conductor interconnection 25 exists independently is f1<f3 due to difference in dielectric constant distribution of dielectrics around the slots 4 or the spiral conductor interconnection 25.

A square region that is the formation region of the slot 4 and a square region that is the formation region of the spiral conductor interconnection 25 each have a portion overlapped in the laminated direction and are cross-coupled with each other. Particularly, by disposing the slot 4 and the spiral conductor interconnection 25 so as to obtain a cross-coupling capacitance over a wide area, the effect of effective increase in an apparent dielectric constant can be obtained. Moreover, as shown in FIG. 5B and FIG. 5C, the spiral winding direction of the slot 4 and the spiral winding direction of the spiral conductor interconnection 25 should preferably be set to be opposite to each other. More particularly, when a radio-frequency displacement current flows via the cross coupling so as to rotate the spirals in the same direction and thereby two circuit structures are connected, a resonator length in a half-wave resonance mode with both the ends being open terminated is set to be longest, by which effective reduction in the resonance frequency can be achieved. Further, with stronger cross coupling, a resonance frequency f0 in the resonator structure having the laminated structure including the slot 4 and the spiral conductor interconnection 25 can be reduced more so that, for example, the resonance frequency f0 can be smaller than a value of ½ of the resonance frequency f1. More particularly, in the resonator 20 in the second embodiment, a resonator in a half-wave resonance mode having a resonator length longer than the resonator length in the conventional resonator having the structure, in which the respective slots adjacently disposed on the same plane are coupled in series, can be obtained with the space occupancy of the conventional one resonator.

Moreover, in the resonator 20 in the second embodiment it is preferable in view of obtaining a lower frequency that, as with the layout of the respective slots 4 and 5 in the resonator 10 in the first embodiment, a outer termination portion 4*a* of the slot 4 and an outer termination portion 25*a* of the spiral conductor interconnection 25 are disposed at positions almost symmetric with respect to a center point O3 of the spiral of the spiral conductor interconnection 25.

Although in the resonator 20 in the second embodiment, description has been given of the structure in which the spiral conductor interconnection 25 is formed on the front surface 7*a* of the second dielectric substrate 7 and the lead frame 4 is formed in between the front surface 6*a* of the first dielectric substrate 6 and the back surface 7*b* of the second dielectric substrate 7, the structure of the resonator 20 in the second embodiment is not limited thereto. Instead of such a structure, for example, a structure in which layout of both the spiral-shaped circuits is reversed, i.e., the slot is formed on the front surface 7*a* of the second dielectric substrate 7 and the spiral conductor interconnection is formed in between the front surface 6*a* of the first dielectric substrate 6 and the back surface 7*b* of the second dielectric substrate 7, can also provide a beneficial effect as in the case of the second embodiment.

Moreover, although in the forgoing description, description has been given of the resonator structure in which the number of interconnection layers formed by laminating the slot 4 and the spiral conductor interconnection 25 in the spiral shape included in the resonator 20 is set at 2, the similar effect can be obtained even if the number of interconnection layers formed by laminating the spiral-shaped circuits (i.e., the slot 4 and the spiral conductor interconnection 25) is expanded to three or more. Particularly, by laminating the spiral-shaped circuits so that their formation regions overlap, the cross coupling may be strengthened, and as for the spiral winding direction of the respective spiral-shaped circuits, by setting the combination of the respective interconnection layers which are adjacently disposed in the laminated direction to be opposite to each other, it becomes possible to produce the resonance phenomenon at the lowest resonance frequency.

WORKING EXAMPLE 2

Next, working examples 2-1 to 2-8 of the resonator in the first embodiment will be described. For the purpose of comparing the structure and the resonance frequency of working examples with those of comparative examples, the working examples 2-1 to 2-4 are shown in Table 3 while the working examples 2-5 to 2-8 are shown in Table 4.

TABLE 3

| | Slot | Spiral conductor interconnection | Additional resin substrate thickness (μm) | Spiral winding direction of two spirals | Overlap of two slots | Resonance frequency (GHz) |
|---|---|---|---|---|---|---|
| Working example 2-1 | Present | Present | 130 | Opposite | — | 2.94 |
| Working example 2-2 | Present | Present | 30 | Opposite | — | 2.48 |
| Working example 2-3 | Present | Present | 130 | Identical | Overlapped | 3.85 |
| Working example 2-4 | Present | Present | 130 | Identical | Not overlapped (180-degree rotation) | 3.83 |

TABLE 3-continued

| | Slot | Spiral conductor interconnection | Additional resin substrate thickness (μm) | Spiral winding direction of two spirals | Overlap of two slots | Resonance frequency (GHz) |
|---|---|---|---|---|---|---|
| Comparative example 2-1 | Present | Absent | 130 | — | — | 4.10 |
| Comparative example 2-2 | Absent | Present | 130 | — | — | 5.19 |

TABLE 4

| | Laminate order of spiral circuit (described in top-down order) | Resonance frequency (GHz) |
|---|---|---|
| Working example 2-5 | Slot<br>Spiral conductor interconnection<br>Slot | 2.72 |
| Working example 2-6 | Spiral conductor interconnection<br>Slot<br>Spiral conductor interconnection | 2.57 |
| Working example 2-7 | Spiral conductor interconnection<br>Spiral conductor interconnection<br>Slot | 2.35 |
| Working example 2-8 | Spiral conductor interconnection<br>Slot<br>Slot | 1.80 |
| Working example 2-1 | Spiral conductor interconnection<br>Slot | 2.94 |
| Comparative example 2-1 | Slot inside | 4.10 |
| Comparative example 2-2 | Spiral conductor interconnection on surface | 5.19 |

As a resonator according to the working example of the first embodiment, a resin substrate with a dielectric constant of 10.2 and a thickness of 640 μm was used as a base substrate (first dielectric substrate 6), a resin substrate (second dielectric substrate 7) with a dielectric constant 10.2 and a thickness of 130 μm was further bonded to the front surface of the base substrate to form a multilayer dielectric substrate 21, and on the multilayer dielectric substrate 21, a radio-frequency circuit based on the conditions as shown in the working example 2-1 in Table 3 was manufactured.

More specifically, a copper interconnection with a thickness of 20 μm was formed as a ground conductor layer 2 in between the base substrate and the resin substrate inside the multilayer dielectric substrate 1. Moreover, a copper interconnection with a thickness of 20 μm was also formed as a conductor interconnection layer 23 on the front surface of the multilayer dielectric substrate 1, i.e., the front surface of the resin substrate. In the ground conductor layer 2 and the conductor interconnection layer 23, spiral-shape slot 4 and spiral conductor interconnection 25 having outer edges of square shapes, 2000 μm on a side, as viewed from the outside were formed. Processing of interconnection patterns was performed by removing desired portions in the ground conductor layer 2 and the conductor interconnection layer 23 by wet etching. A minimum interconnection width and a minimum interval distance between interconnections in the slot and the interconnection were each set at 200 μm. The spiral turning number of both the spiral shapes was set at 2 times. The spiral winding directions of the slot 4 and the spiral conductor interconnection layer 25 were set to be opposite to each other. The resonator according to the thus-structured working example 2-1 produced the resonance phenomenon at a frequency of 2.94 GHz.

A resonator in the comparative example 2-1 as a comparative example for the working example 2-1, in which a conductor interconnection layer was not formed and only a slot was formed in the ground conductor layer, presented a resonance frequency of 4.1 GHz. Further, a resonator in the comparative example 2-2, in which a slot was not formed in the ground conductor layer and only a spiral conductor interconnection was formed in the ground conductor layer, presented a resonance frequency of 5.19 GHz. It is proved that the resonator in the working example 2-1 offers the resonance phenomenon at a lower frequency compared to the resonators in either of the comparative examples.

Moreover, a resonator in the working example 2-2, in which a resin substrate (second dielectric substrate 7) additionally bonded onto the base substrate (first dielectric substrate 6) had a thickness reduced from the thickness of 130 μm set in the working example 2-1 to 30 μm, presented a resonance frequency of 2.48 GHz.

Moreover, a resonator in the working example 2-3, in which under almost the same conditions as those of the working example 2-1, the spiral winding directions of the slot and the spiral conductor interconnection were identical and the spiral shapes were disposed so as to almost overlap with each other, presented a resonance frequency of 3.85 GHz, and therefore could provide the resonance phenomenon at the resonance frequency, not as low as that of the resonator in the working example 2-1 but lower than that of the resonators in the comparative example 2-1 and the comparative example 2-2.

Moreover, a resonator in the working example 2-4, in which with the structure identical to that of the working example 2-3, the spiral conductor interconnection was rotated 180 degrees with respect to the line connecting the centers of the spiral conductor interconnection and the spiral of the slot (i.e., the outer termination portions of the respective spirals were disposed at positions symmetric with respect to a center point of the spirals), presented a resonance frequency of 3.83 GHz, and therefore could provide the resonance phenomenon at the resonance frequency, not as low as that of the working example 2-1 but lower than that of the comparative example 2-1 and the comparative example 2-2.

Moreover, resonators in the working examples 2-5 to 2-8 were manufactured by further bonding a resin substrate with a thickness of 130 μm and a dielectric constant 10.2 as an additional substrate onto the resonator in the working example 2-1. More particularly, the additional substrate was laminated on the front surface of the resin substrate (second dielectric substrate 7) via the conductor interconnection layer 23 to manufacture each of the resonators. Whereas the number of laminated spiral-shaped circuits was two in the working examples 2-1 to 2-4, the number of laminated spiral-shaped circuits was expanded to three in the working examples 2-5 to 2-8. In any of these resonators, the beneficial effect of further reduction of the resonance frequency was achieved.

More specifically, in the resonator in the working example 2-5, still another ground conductor layer (second ground conductor layer) was additionally formed on the front surface of the additional substrate, and in this still another conductor layer, a second slot was formed so as to overlap with the formation regions of the slot 4 (first slot) and the spiral conductor interconnection layer 25. The second slot was identical to the first slot in the shape and the spiral winding direction. The resonator in the working example 2-5 could produce the resonance phenomenon at a frequency of 2.72 GHz.

Further, a resonator in the working example 2-6 was manufactured by changing the laminated structure of the spiral-formed circuits in the working example 2-5, in which with the front surface of the additional substrate as the top face, the spiral-shaped slot (second slot), the spiral conductor interconnection layer 25 and the spiral-shaped slot (first slot 4) were laminated in this order from the top face, to the laminated structure formed in the order of the spiral conductor interconnection, the spiral-shaped slot and the spiral conductor interconnection. The resonator in the working example 2-6 could produce the resonance phenomenon at a frequency of 2.57 GHz.

Further in the working example 2-7, a resonator with a laminated structure of the respective spiral-shaped circuits changed to be in the order of the spiral conductor interconnection, the spiral conductor interconnection and the spiral-shaped slot was produced. Such a resonator in the working example 2-7 produced the resonance phenomenon at a frequency of 2.35 GHz. Further in the working example 2-8, a resonator with a laminated structure of the respective spiral-shaped circuits changed to be in the order of the spiral conductor interconnection, the spiral-shaped slot and the spiral-shaped slot was produced. Such a resonator in the working example 2-8 produced the resonance phenomenon at a frequency of 1.80 GHz.

It is to be noted that in the resonators in the working examples 2-5 to 2-8, the spiral winding directions of the respective laminated spiral-shaped circuits were opposite to those in the spiral-shaped circuits adjacently disposed in the laminated direction, and according to such layout structure, the resonator length could be effectively increased as in the resonators in any of these working examples, the resonance phenomenon was produced at a frequency of not more than 2.72 GHz, the value lower than that of the resonators in the comparative examples 2-1 and 2-2 as well as the resonator in the working example 2-1.

Moreover, in the case where the turning number of the spiral shape was changed in the range of 1 to 2.5 times with the size of the formation region of the spiral-shaped circuit being unchanged, as well as in the case where the size of the formation regions was further expanded and the turning number of the spiral shape was increased in the range of 2.5 to 5 times, the reduction effect of the resonance frequency was obtained as with the case of the resonators in the respective working examples.

Further, in the case where the turning number of two shapes was set at different values, e.g., the turning number of the spiral shape of the slot 4 was 3 times and the turning number of the spiral shape of the spiral conductor interconnection 25 was 1.25 times, the effect was obtained. It is to be noted, however, that the resonance frequency reduction effect was larger when the respective spiral-shaped circuits were identical in the turning number than when they were different in the turning number from each other.

Moreover, when the outer shape of the formation region of the spiral shape was processed to take a shape other than the square, such as polygons and rounds, the beneficial effect of resonance frequency reduction was obtained as with the case of the working example 2-1.

Moreover, in the case where the slot width and the interconnection width of the spiral conductor interconnection were separately reduced from 200 μm to 100 μm and 50 μm, as well as in the case where they were increased to 250 μm and 300 μm, the beneficial effect of resonance frequency reduction could be obtained as with the case of the working example 2-1.

(Third Embodiment)

Figure 6A:
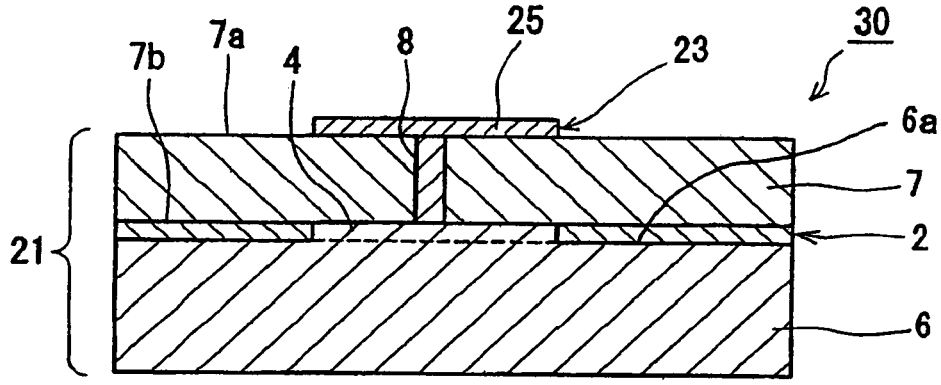
FIG. 6A is a cross sectional view showing a resonator in a third embodiment of the present invention.

Next, the cross section showing the structure of a resonator 30 according to the third embodiment of the present invention is shown in FIG. 6A. In FIG. 6A, component parts identical to those in the respective resonators described above with reference to FIG. 1A, FIG. 4B, FIG. 5C and the like are designated by the same reference numerals and the description thereof is omitted.

As shown in FIG. 6A. a multilayer dielectric substrate 21 is structured from a laminated structure including a first dielectric substrate 6 and a second dielectric substrate 7. In a bonding portion between a front surface 6*a* of the first dielectric substrate 6 and a back surface 7*b* of the second dielectric substrate 7, a ground conductor layer 2 (that is equivalent to the first ground conductor layer 2 in the first embodiment) is formed. Moreover, a conductor interconnection layer 23 is formed on the front surface 7*a* of the second dielectric substrate 7, i.e., on the front surface of the multilayer dielectric substrate 21.

Figure 6B:
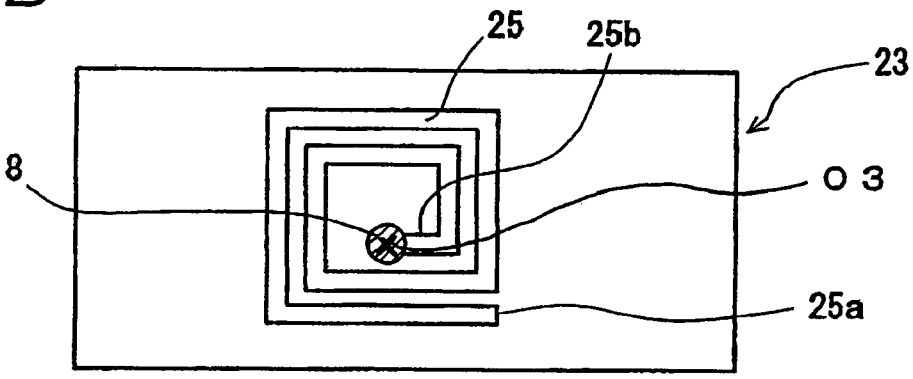
FIG. 6B is a top view showing a ground conductor layer included in the resonator of FIG. 6A.
Figure 6C:
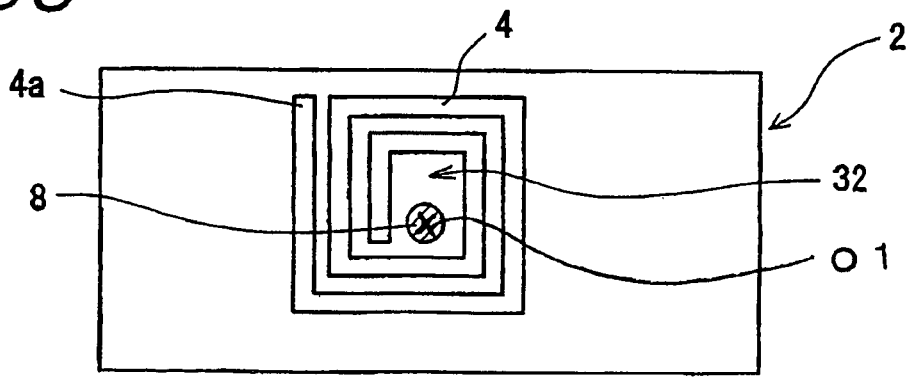
FIG. 6C is a top view showing a conductor interconnection layer included in the resonator of FIG. 6A.

Herein, the top view of the conductor interconnection layer 23 included in the resonator 30 of FIG. 6A is shown in FIG. 6B and the top view of a ground conductor layer 2 is shown in FIG. 6C. As shown in FIG. 6C, in a part of the ground conductor layer 2, a spiral-shaped slot 4 (that is equivalent to the first slot 4 in the first embodiment) is formed. Moreover, as shown in FIG. 6B, in the conductor interconnection layer 23, a spiral-shaped spiral conductor interconnection 25 is formed. The slot 4 and the spiral conductor interconnection 25 are formed in, for example, square shape regions with identical size, each of the square shape regions being formed into a spiral shape having an identical interconnection width, an identical minimum width between interconnections and an identical turning number of the spiral.

Moreover, as shown in FIG. 6B and FIG. 6C, the slot 4 and the spiral conductor interconnection layer 25 are disposed so that a spiral center O1 of the slot 4 and a spiral center O3 of the spiral conductor interconnection 25 are aligned with each other as viewed from the laminated direction of the respective dielectric substrates 6 and 7. Further, the slot 4 and the spiral conductor interconnection layer 25 are disposed so that the outer edges of the formation regions of the square shapes of the slot 4 and the spiral conductor interconnection 25 are also almost aligned with each other.

Moreover, the inside of the slot 4, i.e., a groove-shaped portion in the slot 4, is filled with dielectrics, and in FIG. 6A, a resonance frequency, which is obtained in the case where a resonator structure excluding the spiral conductor interconnection 25 and including only the slot 4 is employed, is assumed to be f1, whereas a resonance frequency, which is obtained in the case where a half-wave resonator structure excluding the slot 4 and including only a spiral conductor interconnection 11 is employed, is assumed to be f3. The relationship between the resonance frequencies f1 and f3 obtained in the case where the slot 4 or the spiral conductor interconnection 25 exists independently is f1<f3 due to difference in dielectric constant distribution of dielectrics around the slots 4 or the spiral conductor interconnection 25.

A square region that is the formation region of the slot 4 and a square region that is the formation region of the spiral conductor interconnection 25 each have a portion overlapping each other and are cross-coupled with each other, and the slot 4 and the spiral conductor interconnection 25 are disposed so as to obtain a cross-coupling capacitance over a wide area.

Moreover, as shown in FIG. 6A, FIG. 6B, and FIG. 6C, a connection through conductor 8 is disposed so as to connect a region inside formation region of the slot 4 and an inner termination portion 25*b* of the spiral conductor interconnection 25 are connected through the second dielectric substrate 7. By connecting the region inside formation region of the slot 4 and the inner termination portion 25*b* of the spiral conductor interconnection 25 each other, an effective increment of the apparent dielectric constant can be obtained, while the entire of the resonator structure can be functioned as a quarter-wave-type resonator, which makes it possible to achieve reduction in circuit size in the resonator.

Moreover, as shown in FIG. 6B and FIG. 6C, the spiral winding direction of the slot 4 and the spiral winding direction of the spiral conductor interconnection layer 25 should preferably be set to be opposite to each other. More particularly, when a radio-frequency current is applied so as to rotate the spirals in the same direction and two circuit structures are connected via the cross coupling, the longest resonator length can be realized.

In the resonator 30 in the third embodiment, the outer portion of the slot 4 is completely terminated in the state of being grounded with respect to radio-frequency, while as the ground conductor layer is away from the peripheral ground conductor layer along the spiral shape of the slot 4 and is led to an inner ground conductor layer 32 positioned in the state of being surrounded with the spiral shape, the slot 4 is no longer completely terminated in the state of being grounded with respect to radio-frequency and has a structure of having a rotated potential. In such a structure, the structure, in which the ground conductor layer 32 inside the spiral shape and the inner termination portion 25*b* of the spiral conductor interconnection 25 are connected via the connection through conductor 8 as described above, is employed so that the rotated phase is further rotated, and therefore the resonator 30 can be functioned as the quarter-wave type resonator which is open terminated in an outer termination portion 25*a* of the spiral conductor interconnection 25 along the spiral shape of the spiral conductor interconnection 25, which effectively increases the resonator length and implements effective reduction in the resonance frequency. Further, with stronger cross coupling, a resonance frequency f0 in the resonator structure having the laminated structure composed of the slot 4 and the spiral conductor interconnection layer 25 can be reduced more so that, for example, the resonance frequency f0 can be smaller than a value of ½ of the resonance frequency f1. More particularly, in the resonator in the third embodiment, a new resonator having a resonator length longer than the resonator length in the conventional resonator having the structure, in which the respective slots adjacently disposed on the same plane are coupled in series, can be obtained with the space occupancy of the conventional one resonator.

Moreover, in the case where a comparative object of the resonance frequency f0 of the resonator 30 in the third embodiment is set to be a resonance frequency f4, which is the resonance frequency in a quarter-wave type resonance in a resonator having a structure in which the inner termination portion 25*b* of the spiral conductor interconnection layer 25 with the identical shape is grounded by the connection through conductor 8 and the slot 4 is not formed in the ground conductor layer 2, the resonance frequency f0 can be a value smaller by a progressed degree of the potential in the slot 4 than the resonance frequency f4.

More particularly, the resonator 30 in the third embodiment creates such a beneficial effect of producing a new resonance phenomenon with a space-saving circuit size and at an extremely low frequency.

WORKING EXAMPLE 3

Next, working examples 3-1 to 3-7 of the resonator in the first embodiment will be described.

For the purpose of comparing the structure and the resonance frequency of working examples with those of comparative examples, the working examples 3-1 to 3-4 are shown in Table 5 while the working examples 3-1, 3-5, 3-6 and 3-7 are shown in Table 6.

TABLE 5

| | Slot | Spiral conductor interconnection | Additional resin substrate thickness (μm) | Spiral winding direction of two spirals | Destination of connection of spiral conductor interconnection in connection through conductor | Overlap of two slots | Resonance frequency (GHz) |
|---|---|---|---|---|---|---|---|
| Working example 3-1 | Present | Present | 130 | Opposite | Inside of slot | — | 1.63 |
| Working example 3-2 | Present | Present | 30 | Opposite | — | — | 1.24 |
| Working example 3-3 | Present | Present | 130 | Identical | — | Overlapped | 2.42 |
| Working example 3-4 | Present | Present | 130 | Identical | — | Not overlapped (180-degree rotation) | 2.30 |
| Comparative example 3-1 | Present | Absent | 130 | — | — | — | 5.07 |

TABLE 5-continued

| | Slot | Spiral conductor interconnection | Additional resin substrate thickness (μm) | Spiral winding direction of two spirals | Destination of connection of spiral conductor interconnection in connection through conductor | Overlap of two slots | Resonance frequency (GHz) |
|---|---|---|---|---|---|---|---|
| Comparative example 3-2 | Absent | Present | 130 | — | Ground conductor layer | — | 2.89 |
| Comparative example 3-3 | Absent | Present | 130 | — | Back surface of ground conductor layer (Back surface of substrate) | — | 3.43 |

TABLE 6

| | Laminate order of spiral circuit (described in top-down order) | Remarks Connection between spiral-shaped circuits | Resonance frequency (GHz) |
|---|---|---|---|
| Working example 3-1 | Spiral conductor interconnection<br>Slot | Inside of slot and inner termination portion of spiral conductor interconnection is connected | 1.63 |
| Working example 3-5 | Second slot<br>Spiral conductor interconnection<br>First slot | Insides of first slot and second slot and inner termination portion of spiral conductor interconnection are connected | 1.39 |
| Working example 3-6 | Second spiral conductor interconnection<br>First spiral conductor interconnection<br>Slot | Second spiral conductor interconnection and first spiral conductor interconnection are not connected | 1.41 |
| Working example 3-7 | Second spiral conductor interconnection<br>First spiral conductor interconnection<br>Slot | Second spiral conductor interconnection and first spiral conductor interconnection are connected by connection through conductor (First spiral conductor interconnection is connected to slot in inner termination portion and to second spiral conductor interconnection in outer termination portion) | 0.98 |
| Comparative example 3-1 | Slot inside | — | 5.07 |
| Comparative example 3-2 | Spiral conductor interconnection on surface | Ground conductor layer | 2.89 |
| Comparative example 3-3 | Spiral conductor interconnection on surface | Ground conductor layer on back surface (back surface of substrate) | 3.43 |

As a working example of the resonator in the third embodiment, a resin substrate with a dielectric constant of 10.2 and a thickness of 640 μm was used as a base substrate (first dielectric substrate 6), a resin substrate (second dielectric substrate 7) with a dielectric constant 10.2 and a thickness of 130 μm was further bonded to the front surface of the base substrate to form a multilayer dielectric substrate 21, and on the multilayer dielectric substrate 21, a radio-frequency circuit based on the conditions as shown in the working example 3-1 in Table 5 was manufactured.

More specifically, a copper interconnection with a thickness of 20 μm was formed as a ground conductor layer 2 in between the base substrate and the resin substrate inside the multilayer dielectric substrate 1. Moreover, a copper interconnection with a thickness of 20 μm was also formed as a conductor interconnection layer 23 on the front surface of the multilayer dielectric substrate 21, i.e., the front surface of the resin substrate. In the ground conductor layer 2 and the conductor interconnection layer 23, spiral-shape slot 4 and spiral conductor interconnection 25 having outer edges of square shapes, 2000 μm on a side, as viewed from the outside were formed. Processing of interconnection patterns was performed by removing desired portions in the ground conductor layer 2 and the conductor interconnection layer 23 by wet etching. A minimum interconnection width of the respective interconnections and a minimum interval distance between interconnections were each set at 200 μm. The spiral turning number of both the spiral shapes was set at 2, the spiral winding directions of the slot 4 and the spiral conductor interconnection layer 25 were set to be opposite to each other, and a connection through conductor 8 with a diameter of 200 μm was formed vertically (i.e., in the laminated direction) so as to connect an inner termination portion 25*b* of the spiral conductor interconnection layer 25 and a ground conductor layer in the inner region surrounded with the spiral shape of the slot 4. Thus-structured resonator according to the working example 3-1 produced the resonance phenomenon at a frequency of 1.63 GHz.

A resonator in the comparative example 3-1 as a comparative example for the working example 3-1, in which a conductor interconnection layer was not formed and only a slot was formed in the ground conductor layer, presented a resonance frequency of 5.07 GHz. Further, a resonator in the comparative example 3-2, in which a slot was not formed in the ground conductor layer and only a spiral conductor interconnection was formed in the ground conductor layer, presented a resonance frequency of 2.89 GHz. Moreover, a resonator in the comparative example 3-3, in which a connection through conductor with a diameter of 200 μm was formed for connecting the inner termination portion of the spiral conductor interconnection and the ground conductor layer as with the case of the working example 3-1, presented a resonance frequency of 3.43 GHz. The resonator in the working example 3-1 produced the resonance phenomenon at a frequency lower than that of the resonators in either of the comparative examples, which proved that the beneficial effect of the third embodiment was implemented.

Moreover, a resonator in the working example 3-1, in which a resin substrate (second dielectric substrate 7) additionally bonded onto the base substrate (first dielectric substrate 6) had a width size reduced from the width size of 130 μm set in the working example 3-1 to 40 μm, presented a resonance frequency of 1.24 GHz, which indicated that more beneficial effect was obtained.

Moreover, a resonator in the working example 3-3, in which under almost the same conditions with those of the working example 3-1, the spiral winding directions of the slot 4 and the spiral conductor interconnection layer 25 were identical and the spiral shapes of the slot 4 and the spiral conductor interconnection 25 were laminated in the state of roughly overlapping with each other, presented a resonance frequency of 2.42 GHz, and although the effect of resonance frequency reduction was small compared to that in the working example 3-1, the resonator could produce the resonance phenomenon at a resonance frequency lower than that of the comparative example 3-1 and the comparative example 3-2.

Moreover, a resonator in the working example 3-4, obtained from the resonator in the working example 3-3 by rotating the formation direction of the spiral conductor interconnection 25 180 degrees with the center of the spiral as an axis, presented a resonance frequency of 2.30 GHz, and although the effect of resonance frequency reduction was small compared to that in the working example 3-1, the resonator could produce the resonance phenomenon at a resonance frequency lower than that of the comparative example 3-1 and the comparative example 3-2.

Moreover, in the case where the turning number of the spiral shape was changed in the range of 1 to 2.5 times with the size of the spiral formation region being unchanged, the effect in the third embodiment was obtained.

Further, in the case where the spiral formation region was further expanded and the turning number of the spiral shape was increased in the range of 2.5 to 5 times, if the turning number of two spiral shapes was set at different values, e.g., the turning number of the spiral shape of the first slot 4 was 3 times and the turning number of the spiral shape of the spiral conductor interconnection layer 25 was 1.25 times, the effect of resonance frequency reduction was still observed. It is to be noted, however, the resonance frequency reduction effect was larger when two spiral shapes were identical in the turning number than when they were different in the turning number from each other.

Moreover, when the outer shape of the formation region of the spiral shape was processed to take a shape other than the square, such as polygons and rounds, the beneficial effect of resonance frequency reduction was obtained as with the case of the working example 3-1.

Moreover, in the case where the slot width and the interconnection width of the spiral conductor interconnection were separately reduced from 200 μm to 100 μm and 50 μm, as well as in the case where they were increased to 250 μm and 300 μm, the beneficial effect of resonance frequency reduction could be obtained as with the case of the working example 3-1.

Moreover, resonators in the working examples 3-5 to 3-7 were manufactured by bonding a resin substrate with a thickness of 130 μm and a dielectric constant of 10.2 onto the resonator in the working example 3-1 as an additional substrate (i.e., third dielectric substrate), i.e., by bonding the additional substrate on a front surface 7*a* of a second dielectric substrate 7 via a conductor interconnection layer 23. While the laminate number of the spiral-shaped circuits (i.e., the slot 4 and the spiral conductor interconnection 25) in the resonators in the working example 3-1 to 3-4 were limited to 2, the laminate number of the spiral-shaped circuits in the working examples 3-5 to 3-7 was expanded to 3 and as a result, the beneficial effect of further reduction of the resonance frequency was obtained in either examples.

Figure 7A:
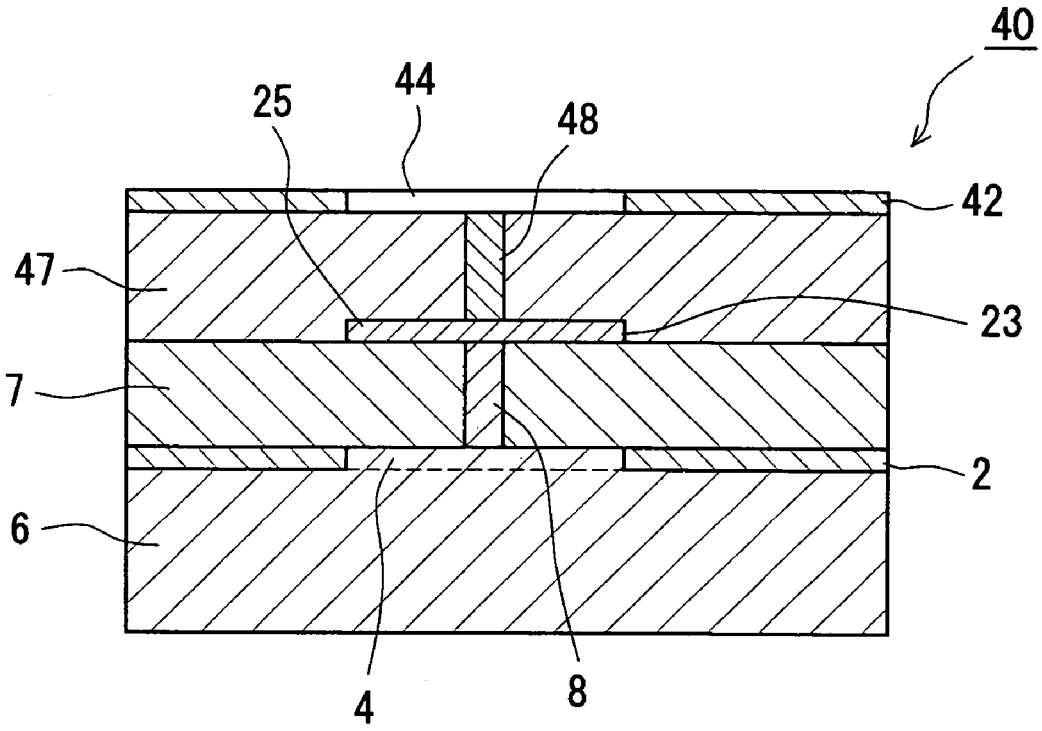
FIG. 7A is a cross sectional view showing a resonator in working examples 3 to 5 of the third embodiment.
Figure 7B:
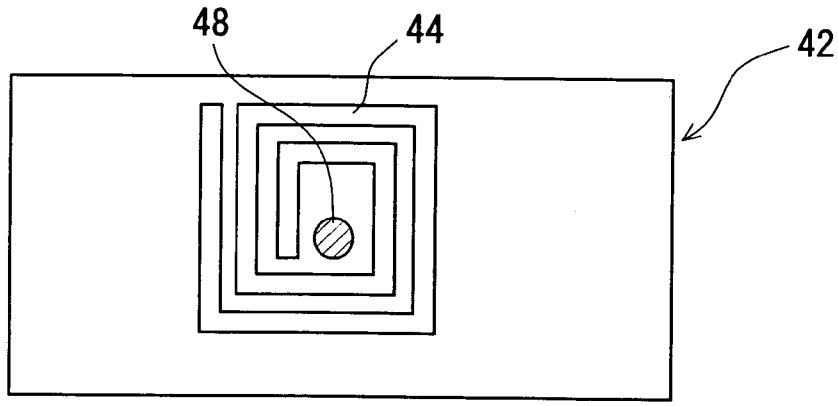
FIG. 7B is a top view showing a second ground conductor layer included in the resonator of FIG. 7A.
Figure 7C:
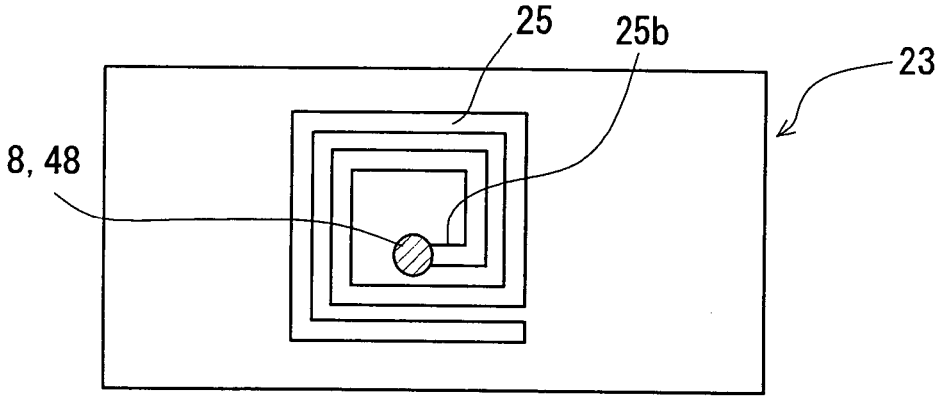
FIG. 7C is a top view showing a conductor interconnection layer included in the resonator of FIG. 7A.
Figure 7D:
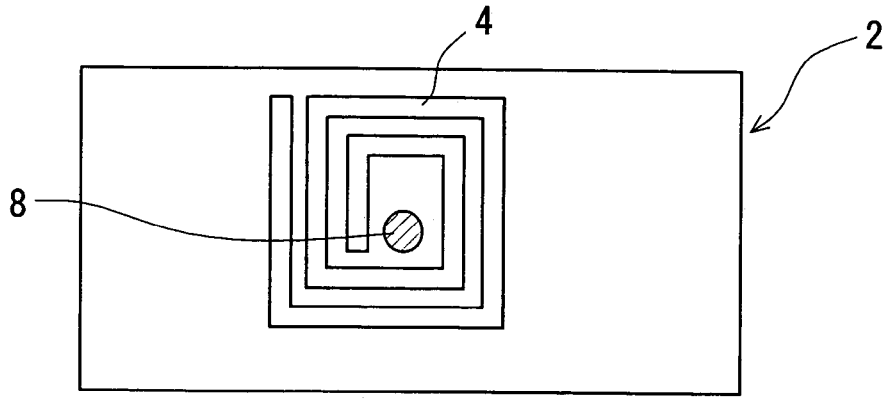
FIG. 7D is a top view showing a first ground conductor layer included in the resonator of FIG. 7A.
Figure 8A:
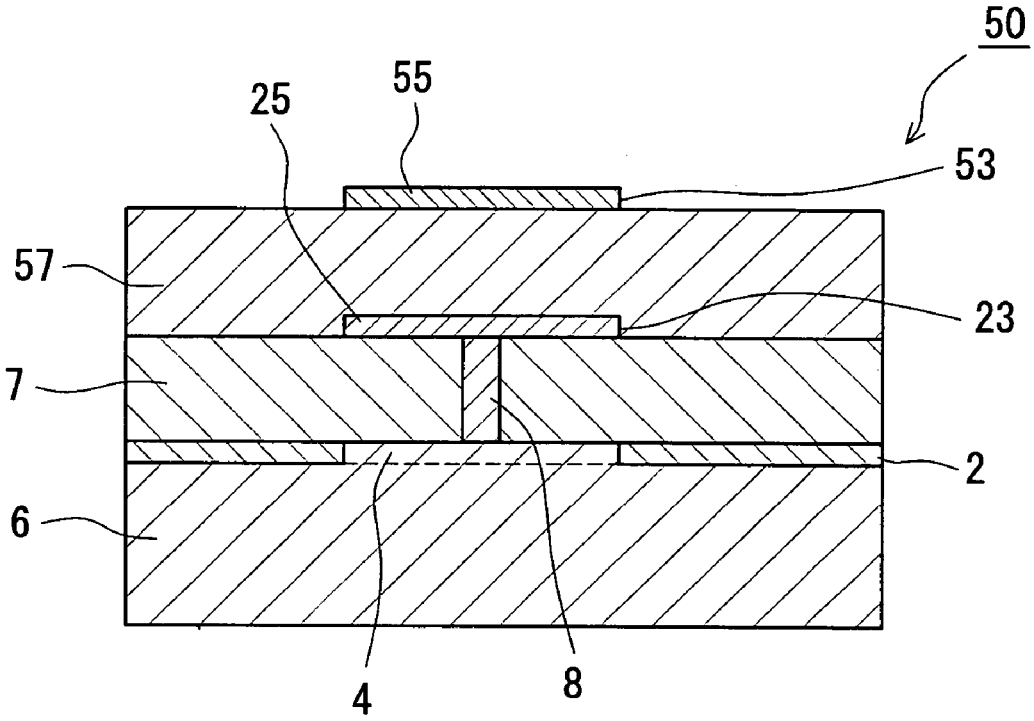
FIG. 8A is a cross sectional view showing a resonator in working examples 3 to 6 of the third embodiment for showing the structure in which a first conductor interconnection layer and a second conductor interconnection layer are not connected to each other.
Figure 8B:
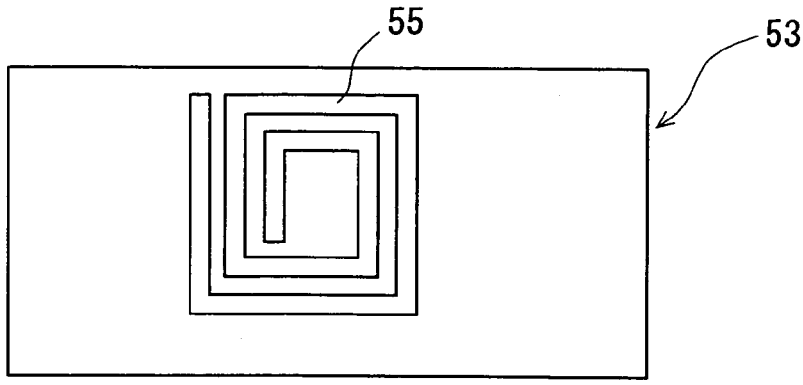
FIG. 8B is a top view showing the second conductor interconnection layer included in the resonator of FIG. 8A.
Figure 8C:
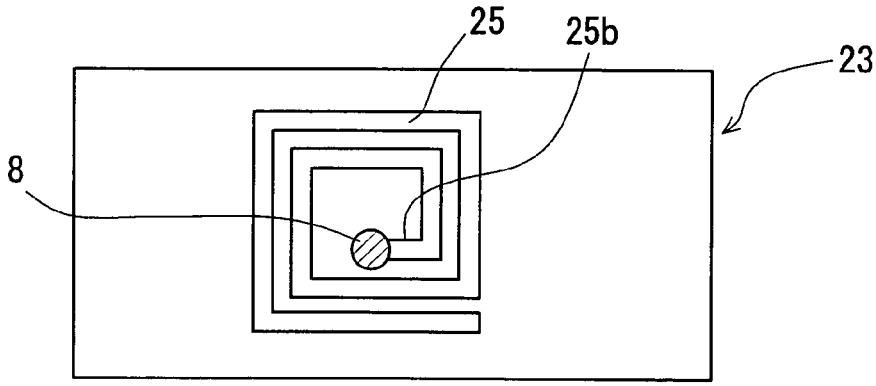
FIG. 8C is a top view showing the first conductor interconnection layer included in the resonator of FIG. 8A.
Figure 8D:
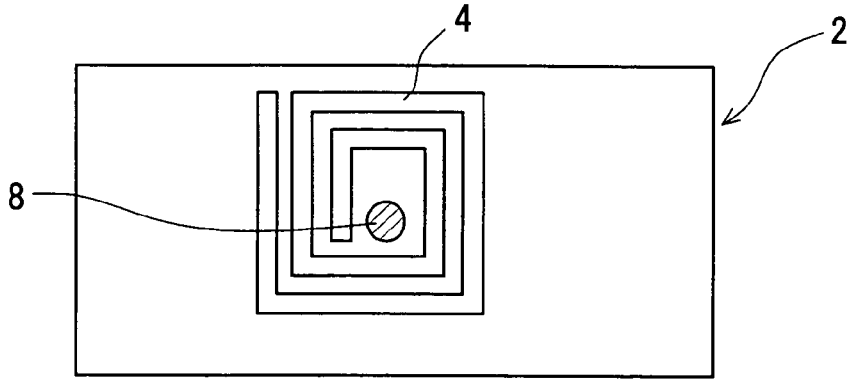
FIG. 8D is a top view showing a ground conductor layer included in the resonator of FIG. 8A.
Figure 9A:
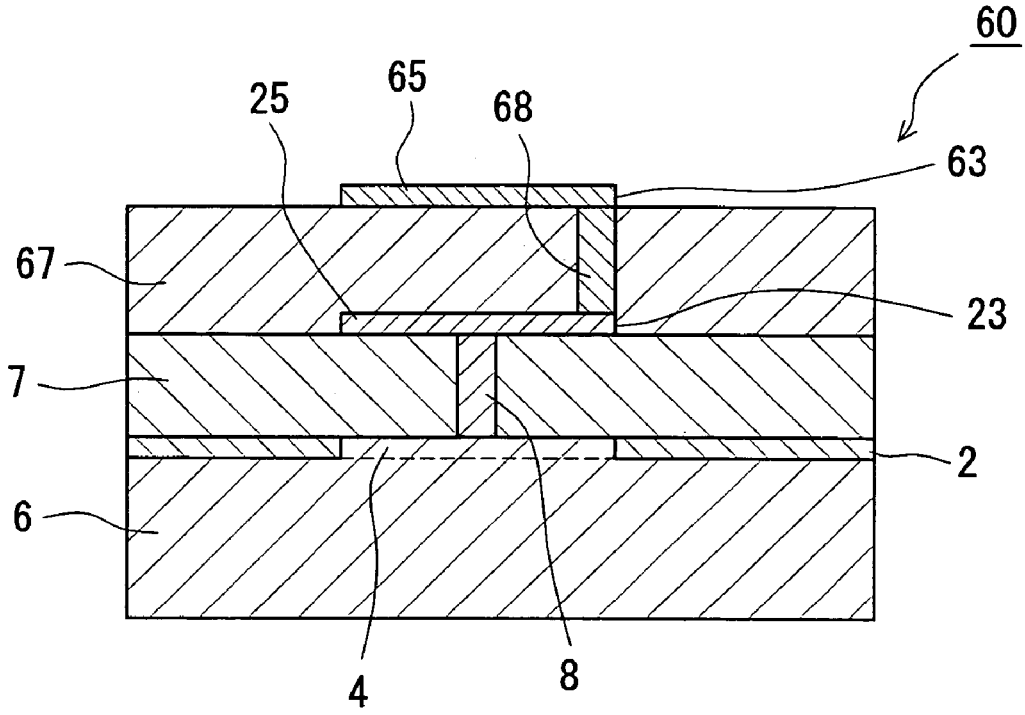
FIG. 9A is a cross sectional view showing a resonator in working examples 3 to 7 of the third embodiment for showing the structure in which a first conductor interconnection layer and a second conductor interconnection layer are connected to each other.
Figure 9B:
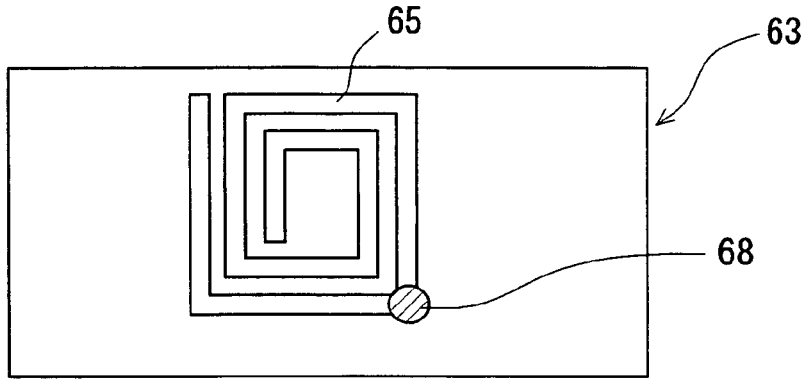
FIG. 9B is a top view showing the second conductor interconnection layer included in the resonator of FIG. 9A.
Figure 9C:
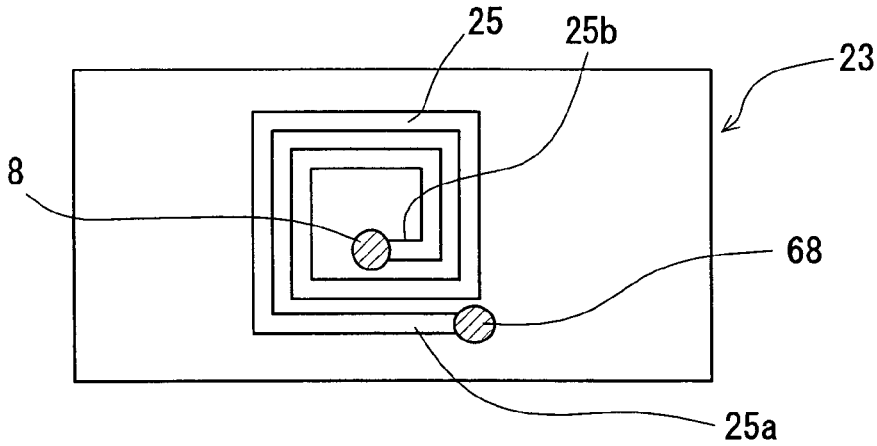
FIG. 9C is a top view showing the first conductor interconnection layer included in the resonator of FIG. 9A.
Figure 9D:
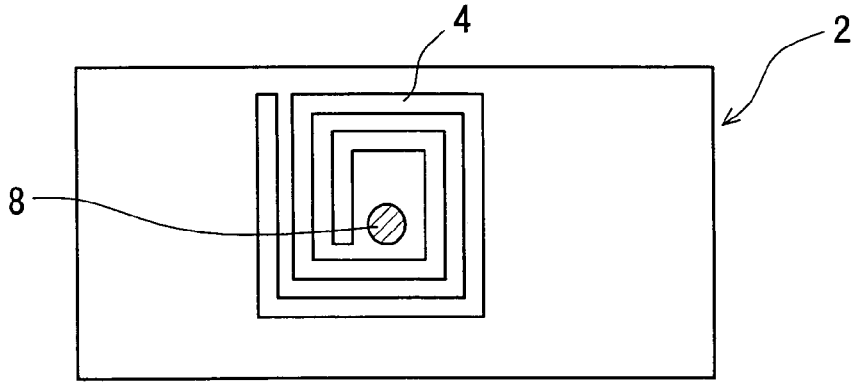
FIG. 9D is a top view showing a ground conductor layer included in the resonator of FIG. 9A.

Herein, the cross sectional view of a resonator 40 in the working example 3-5 is shown in FIG. 7A and the top views of respective spiral-shaped circuit formation layers included in the resonator 40 are shown in FIG. 7B, FIG. 7C and FIG. 7D. Similarly, the cross sectional view of a resonator 50 in the working example 3-6 is shown in FIG. 8A and the top views of respective spiral-shaped circuit formation layers included in the resonator 50 are shown in FIG. 8B, FIG. 8C and FIG. 8D. Further, the cross sectional view of a resonator 60 in the working example 3-7 is shown in FIG. 9A and the top views of respective spiral-shaped circuit formation layers included in the resonator 50 are shown in FIG. 9B, FIG. 9C and FIG. 9D.

As shown in FIG. 7A, FIG. 7B, FIG. 7C and FIG. 7D, in the resonator 40 in the working example 3-5, on a front surface 47*a* of an additional substrate 47 bonded to a front surface 7*a* of a second dielectric substrate 7, a second ground conductor layer 42 was further formed, and a second slot 44 was formed so as to overlap with a slot 4 (first slot) that was a spiral-shaped circuit in a ground conductor layer 2 laminated downward in the laminate direction as viewed in the drawing. The second slot 44 was identical to the first slot 4 in shape and was disposed in the spiral winding direction identical to the first slot 4. The spiral shapes of the second slot 44, the spiral conductor interconnection layer 25 and the first slot 4 were set reversed to respective adjacent layers thereof. The spiral conductor interconnection layer 25 was connected in an inner termination portion 25*b* of the spiral shape to the ground conductor layer 2 in the region inside the first slot 4 through a connection through conductor 8, and was further connected to the second ground conductor layer 42 in the region inside the second slot 44 through a connection through conductor 48. Thus-structured resonator 40 in the working example 3-5 produced the resonance phenomenon at a frequency of 1.39 GHz which was lower than that of any resonators in the working example 3-1, the comparative examples 3-1 and 3-2.

Further, in the resonator 40 in the working example 3-5, in the laminated structure of the respective spiral-shaped circuits laminated in a top-down order of a spiral slot, a spiral conductor interconnection and a spiral slot in the laminate direction as viewed in the drawing, the uppermost spiral slot was replaced with a second spiral conductor interconnection, and resonators having the laminated structure in the order of a second spiral conductor interconnection, a first spiral conductor interconnection and a spiral slot were produced as resonators 50, 60 in the working examples 3-6 and 3-7. More particularly, as shown in FIG. 8A to FIG. 8D and FIG. 9A to FIG. 9D, the resonators 50 and 60 including second conductor interconnection layers 53, 63 formed on front surfaces 57*a*, 67*a* of additional substrates 57, 67 and second spiral conductor interconnections 55, 65 formed in the second conductor interconnection layers 53, 63 were manufactured. Moreover, in the resonator 50 in the working example 3-6 and the resonator 60 in the working example 3-7, the spiral-shaped circuits adjacent to each other in the laminate direction were set opposite to each other in the spiral winding direction.

Moreover, as shown in FIG. 9A to FIG. 9D, in the resonator 60 in the working example 3-7, a first spiral conductor interconnection 25 and a second spiral conductor interconnection 65 were electrically connected in the outer termination portion 25*a* of the first spiral conductor interconnection 25 through a connection through conductor 68. As shown in FIG. 8A to FIG. 8D, in the resonator 50 in the working example 3-6, a first spiral conductor interconnection 25 and a second spiral conductor interconnection 55 were not electrically connected but coupled via a cross-coupling capacitance. Thus-structured resonator 50 in the working example 3-6 produced the resonance phenomenon at 1.41 GHz, while the resonator 60 in the working example 3-7 produced the resonance phenomenon at 0.98 GHz.

The resonator 40 in the working example 3-5 and the resonator 60 in the working example 37 were common in the resonator laminated structure including three spiral-type structures in which adjacent spiral-type resonator structures were set to take a shape opposite to each other and the adjacent spiral-type structures were all connected via the connection through conductor, while the termination points of the resonators were set to be termination points of the slot-type resonator structures. Therefore, the resonator 60 in the working example 3-7 whose entire resonator structures operated in away of a quarter-wave-type resonator could produce the resonance phenomenon at a frequency lower than that of the resonator 40 in the working example 3-5 whose entire resonator structures operated in a way of a half-wave-type resonator, because the resonator 60 included the spiral conductor interconnection, one end of which was terminated in the state of being grounded.

Further, the resonator 50 in the working example 3-6, although having a structure similar to the resonator 60 in the working example 3-7, had two spiral conductor interconnections not connected through the connection through conductor. Therefore, the resonator 50 in the working example 3-6 has a resonance structure in which a quarter-wave-type resonator structure including the slot and the first spiral conductor interconnection is weakly coupled with the second spiral conductor interconnection that is a half-wave-type resonator through a cross-coupling capacitance. In the case of the resonator 60 in the working example 3-7, a resonator structure formed by strong coupling between the first spiral conductor interconnection and the second spiral conductor interconnection is directly coupled with the slot, and this makes it possible to form a quarter-wave-type resonator structure strong in all the inter-layer bonding, thereby allowing the lowest resonance frequency to be obtained.

(Fourth Embodiment)

Figure 10A:
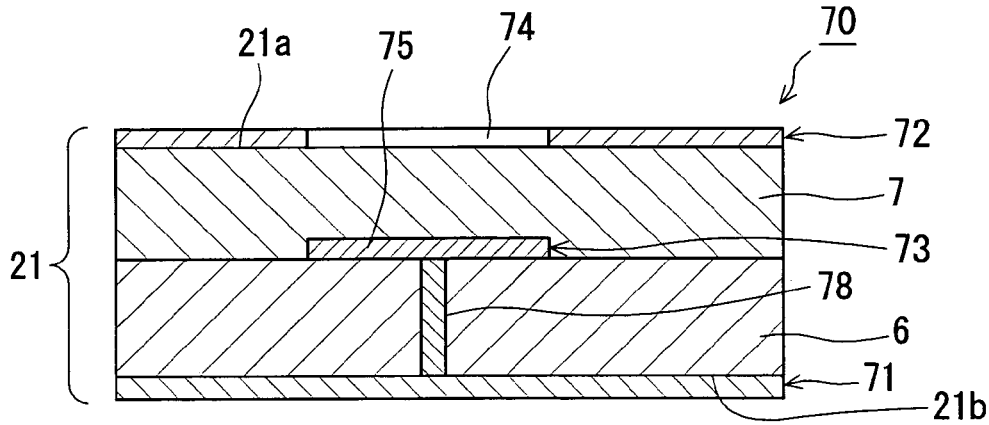
FIG. 10A is a cross sectional view showing a resonator in a fourth embodiment of the present invention.

Next, the cross sectional view showing the structure of a resonator 70 according to the fourth embodiment of the present invention is shown in FIG. 10A. In FIG. 10A, component parts identical to those in the respective resonators described before are designated by the same reference numerals and the description thereof is omitted.

As shown in FIG. 10A, the multilayer dielectric substrate 21 is structured from a laminated structure including a first dielectric substrate 6 and a second dielectric substrate 7. In a bonding portion between a front surface 6*a* of the first dielectric substrate 6 and a back surface 7*b* of the second dielectric substrate 7, a ground conductor layer 73 is formed. Moreover, a first ground conductor layer 72 is formed on the front surface 7*a* of the second dielectric substrate 7, i.e., on the front surface of the multilayer dielectric substrate 21.

Figure 10B:
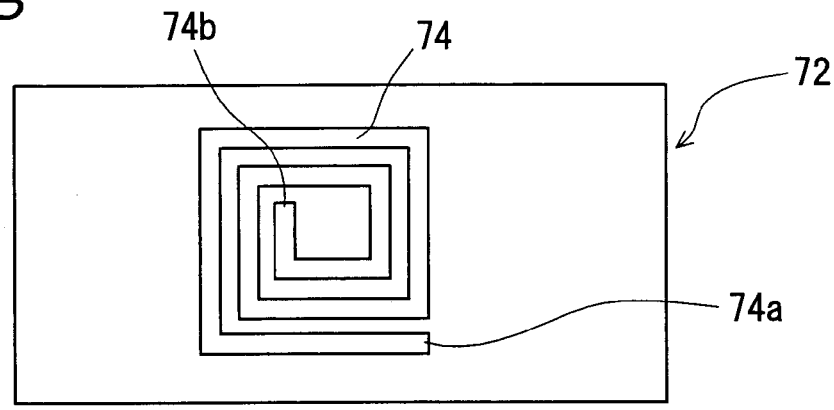
FIG. 10B is a top view showing a first ground conductor layer included in the resonator op FIG. 10A.
Figure 10C:
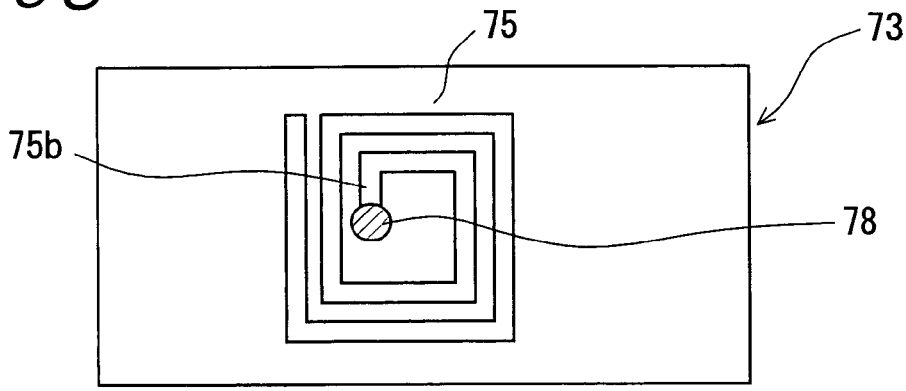
FIG. 10C is a top view showing a conductor interconnection layer included in the resonator of FIG. 10A.

Herein, the top view of the first ground conductor layer 72 included in the resonator 70 of FIG. 10A is shown in FIG. 10B and the top view of the ground conductor layer 73 is shown in FIG. 10C. As shown in FIG. 10B, in the first ground conductor layer 72, a spiral-shaped slot 74 is formed, and as shown in FIG. 10C, in the ground conductor layer 73, a spiral-shaped spiral conductor interconnection 75 is formed.

Moreover, as shown in FIG. 10B and FIG. 10C, the spiral center of the slot 74 and the spiral center of the spiral conductor interconnection 73 are disposed so as to be aligned with each other, and further the outer edges of the formation regions of the respective spiral shapes are also disposed so as to be aligned with each other. It is to be noted that the respective winding directions were set to be opposite to each other.

Further, as shown in FIG. 10A, a second ground conductor layer 71 is formed on a back surface 6*b* of the first dielectric substrate 6, i.e., on the back surface of the multilayer dielectric substrate 21. Therefore, the resonator 70 has a laminated structure laminated in the order of the first ground conductor layer 72, the ground conductor layer 73 and the second ground conductor layer 71 in the laminate direction. It is to be noted that a slot is not formed in the second ground conductor layer 71. Moreover, as shown in FIG. 10A and FIG. 10C, a connection through conductor 78 is disposed so as to go through the first dielectric substrate 6 in the laminate direction for connecting an inner termination portion 75*b* of the spiral-shaped spiral conductor interconnection 75 and the second ground conductor layer 71.

It is to be noted that in the fourth embodiment, the multilayer dielectric substrate 21 having the laminated structure of the first dielectric substrate 6 and the second dielectric substrate 7 exemplifies the dielectric substrate, and the first ground conductor layer 72 is formed on a front surface 21*a* of the multilayer dielectric substrate 21 while the second ground conductor layer 71 is formed on a back surface 21*b* of the multilayer dielectric substrate 21. Further, in between the respective ground conductor layers 71 and 72, i.e., in a bonding portion between the first dielectric substrate 6 and the second dielectric substrate 7, which is an inner layer face of the multilayer dielectric substrate 21, the conductor interconnection layer 73 is formed.

According to the resonator 70 in the fourth embodiment having such a structure, the resonance phenomenon in a new half-wave resonance mode having a resonator length longer than that in the conventional resonator having the structure, in which the respective slots adjacently disposed on the same plane are coupled in series, can be obtained with the space occupancy of the conventional one resonator.

For example, in the conventional resonator structure having only the slot 74, an effective distance between termination points on both the ends of the slot 74 is a resonator length of the half-wave resonator. In the resonator in the fourth embodiment, for example, in a half-wave-type resonance mode using one end of the outer termination portions 74*a* of the slot 74 as a reflection point, a radio-frequency current flows along an outermost slot portion and before reaching a termination point 74*b* of the slot portion, the radio-frequency current moves to the spiral-shaped spiral conductor interconnection 75 via a cross-coupling capacitance. Further in the spiral-shaped spiral conductor interconnection 75, the radio-frequency current flows in the same direction and before reaching the termination point of the spiral-shaped spiral conductor interconnection 75, the radio-frequency current moves again to the slot 74. Although the resonator eventually has a half-wave-type resonator structure having both the ends of the slot 74 as termination points, coupling to a quarter-wave-type spiral-shaped spiral conductor interconnection 75 makes it possible to obtain a resonator length considerably larger than the conventional slot. Moreover, compared to the resonator functioning as a quarter-wave resonator in the third embodiment, the resonator of the present embodiment is inferior in the point of circuit area reduction since the resonator structure functions as a half-wave resonator, but is advantageous in terms of manufacturing since it is not necessary to connect the connection through conductor 78 which requires a relatively wide area to a narrow portion in the middle section of the slot formation region. Moreover, in the case where the characteristics of the half-wave resonator are necessary as circuit characteristics, the resonator in the fourth embodiment has a structure having the smallest circuit space occupancy.

The effects obtained by such a resonator 70 in the fourth embodiment will be further described in detail with use of working examples.

As a working example 4-1 for such a resonator, a resin substrate with a dielectric constant of 10.2 and a thickness of 640 μm was used as a base substrate 6 (first dielectric substrate 6), a resin substrate 7 (second dielectric substrate 7) with a dielectric constant 10.2 and a thickness of 130 μm was further bonded to the front surface of the base substrate to form a multilayer dielectric substrate 21, and on the multilayer dielectric substrate 21, a radio-frequency circuit having the laminated structure in the fourth embodiment was manufactured.

More specifically, a copper interconnection with a thickness of 20 μm was formed as a first ground conductor layer 72 on the front surface of the multilayer dielectric substrate 21. Moreover, a copper interconnection with a thickness of 20 μm was also formed as a second ground conductor layer 71 on the back surface of the multilayer dielectric substrate 21. Moreover, a copper interconnection with a thickness of 20 μm was also formed as a ground conductor layer 73 inside the multilayer dielectric substrate 21, i.e., in a bonding portion between the base substrate 6 and the resin substrate 7. In the first ground conductor layer 72 and the conductor interconnection layer 73, spiral-shape slot 74 and spiral conductor interconnection 75 each having a square spiral shape, 2000 μm on a side, as viewed from the outside were formed.

Processing of such interconnection patterns was performed by removing desired portions in the first ground conductor layer 72 and the ground conductor layer 73 by wet etching. A minimum interconnection width of the respective interconnections and a minimum interval distance between interconnections were each set at 200 μm. The spiral turning number of the slot 74 was set at 2.5 times while the spiral turning number of the spiral conductor interconnection 75 was set at 2 times, and the spiral winding directions of the slot 74 and the spiral conductor interconnection 75 were set to be opposite to each other. Further, the inner termination portion 75*b* of the spiral conductor interconnection 75 and the second ground conductor layer 71 were connected through a connection through conductor 78 with a diameter of 200 μm.

The resonator in the working example 4-1 having such a structure presented the resonance phenomenon at 1.72 GHz. This value was lower than the resonance frequency value of 2.91 GHz presented by the resonator in the comparative example 4-1 which excluded the connection through conductor, which proved the beneficial effect of the fourth embodiment.

(Connection to External Circuit)

Description is now given of how to connect the resonators in the respective embodiments to an external circuit.

Figure 11A:
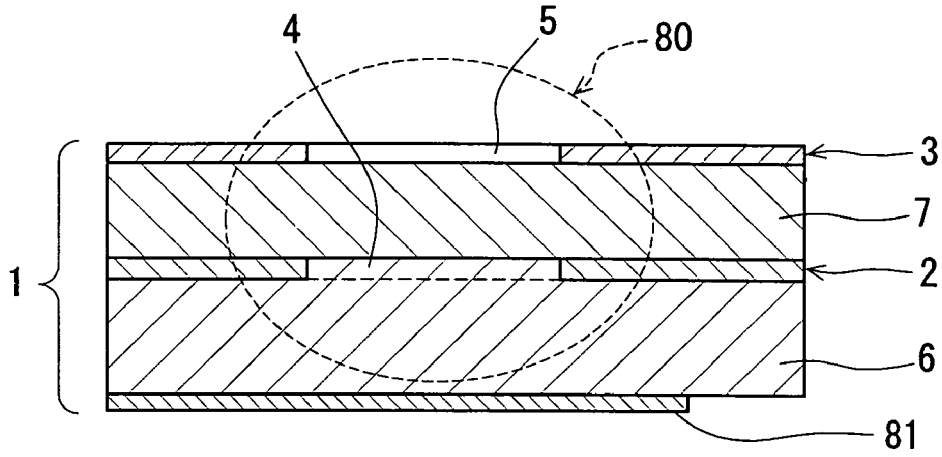
FIG. 11A is a cross sectional view showing the connection structure between the resonator and an external circuit in the respective embodiments of the present invention.
Figure 11B:
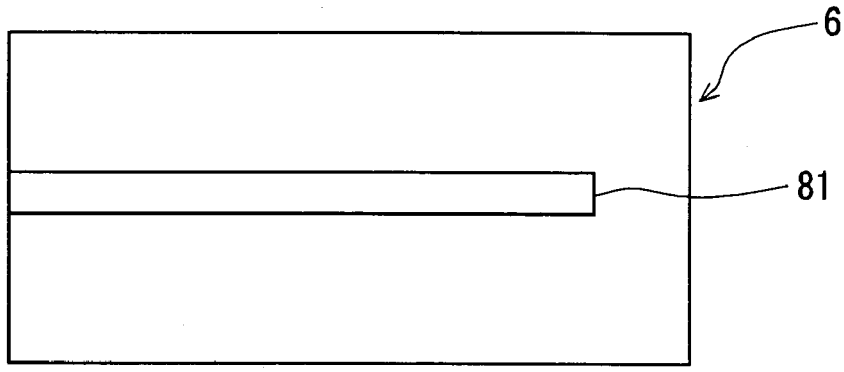
FIG. 11B is a plane view showing a signal conductor interconnection layer connected to an external circuit.

As an example of such connection structure to an external circuit, the cross sectional view showing the connection structure between a resonator 80 and an external circuit is shown in FIG. 11A. In the resonator 10 in FIG. 11A, the plane face showing a first dielectric substrate 6 as viewed from the back surface is shown in FIG. 11B while the plane view showing a first ground conductor layer 2 as viewed from the back surface is shown in FIG. 1C.

Figure 11C:
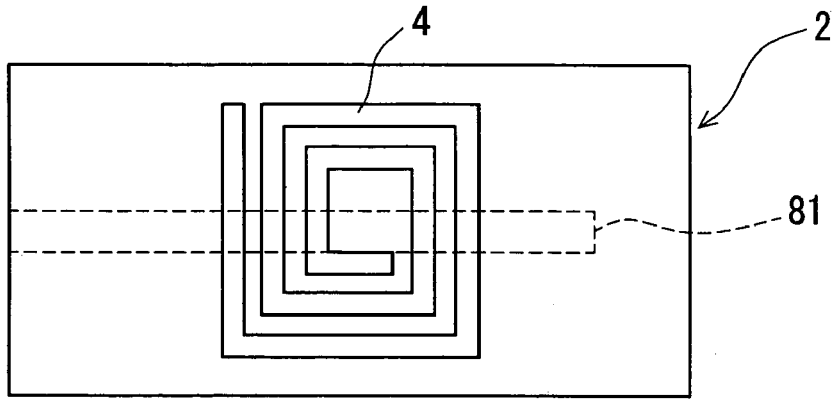
FIG. 11C is a view showing an inner surface of a first ground conductor layer included in the resonator of FIG. 11A.

As shown in FIG. 11A to FIG. 1C, in a multilayer dielectric substrate 1 including the first dielectric substrate 6 and a second dielectric substrate 7, the first ground conductor layer 2 and a second ground conductor layer 3 are formed like the first embodiment to form the resonator 80 having the laminated structure of a first slot 4 and a second slot 5. On the back surface of the multilayer dielectric substrate 1 shown in the drawing, a signal conductor interconnection 81 connected to an external circuit (unshown) is formed. It is to be noted that in FIG. 11C, the formation position of the first slot 4 in the first ground conductor layer 2 is illustrated while at the same time, a projection of the signal conductor interconnection 81 to the first ground conductor layer 2 is also illustrated for understanding of the overlap of the signal conductor interconnection 81 and the first slot 4. Moreover, although a transmission line 85 comprising thus-formed second connecting shaft 81 and the first ground conductor layer 2 is expressed as a microstrip line structure in the drawing, it may also be embodied as a slot line or a coplanar line. Moreover, it is naturally understood that the signal conductor interconnection 81 may be formed on the substrate inner layer face instead on the back surface of the multilayer dielectric substrate 1. Such connection structure of the resonator 80 and the signal conductor interconnection 81 allows use of the resonator 80 electromagnetically coupled with an external circuit via the signal conductor interconnection 81.

Moreover, in the case where the signal conductor interconnection 81 is formed on a plane different from the plane on which the resonator 80 is formed, disposing the signal conductor interconnection 81 so as to overlap with a part of the resonator 80 allows sufficient coupling to be established between the signal conductor interconnection 81 and the resonator 80. In this case, the signal conductor interconnection 81 does not have to be open terminated. Moreover, the termination shape of the signal conductor interconnection 81 may be a ring shape.

Figure 12A:
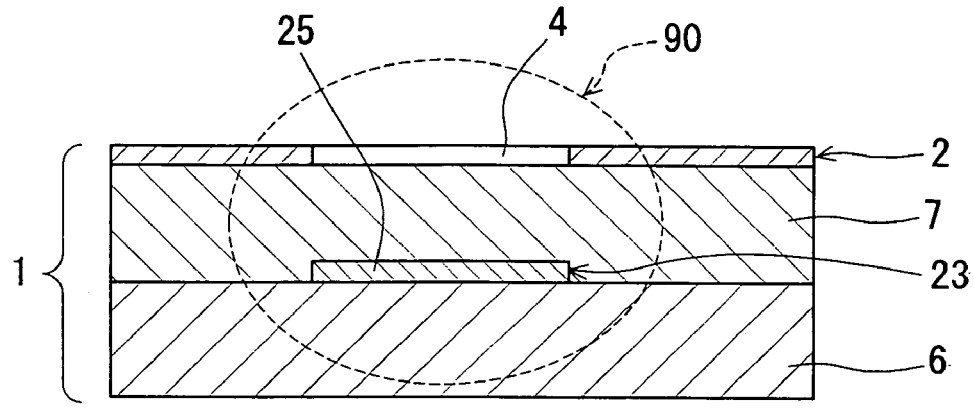
FIG. 12A is a cross sectional view showing still another connection structure between the resonator and an external circuit.
Figure 12B:
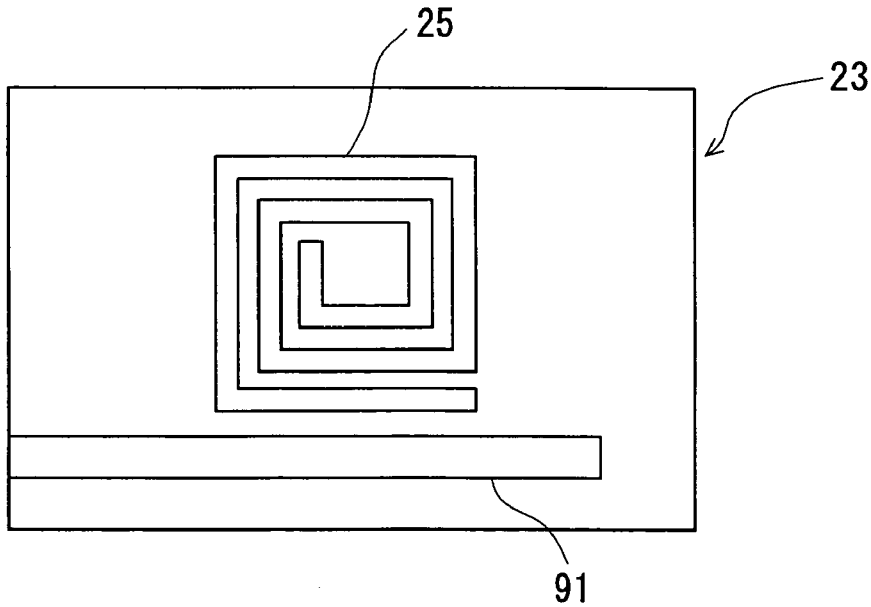
FIG. 12B is a view showing an inner surface of a conductor interconnection layer included in the resonator of FIG. 12A.

Description is now given of another connection structure to an external circuit with reference to the cross sectional view of a resonator 90 shown in FIG. 12A and the internal view of a conductor interconnection layer shown in FIG. 12B.

As shown in FIG. 12A, the resonator 90 has a laminated structure in which a conductor interconnection layer 23 is formed in between a first dielectric substrate 6 and a second dielectric substrate 7 and a ground conductor layer 2 is formed on a front surface 7*a* of the second dielectric substrate 7. Moreover, a spiral conductor interconnection 25 is formed in a conductor interconnection layer 23 and a slot 4 is formed in the ground conductor layer 2.

Further, as shown in FIG. 12B, with use of at least one layer on which the resonator 90 is formed, e.g., with use of the layer on which the conductor interconnection layer 23 is formed, a signal conductor interconnection 91 is formed, and further the signal conductor interconnection 91 is disposed adjacent to the spiral conductor interconnection 25. Thus, at least one layer on which the resonator 90 is formed is used to form the signal conductor interconnection 91 and the formed signal conductor interconnection 91 is disposed adjacent to a part of the resonator 90, so that a coupling between the signal conductor interconnection 91 and the resonator 90 can be established. Therefore, connecting the signal conductor interconnection 91 to an external circuit (unshown) allows use of the resonator 90 coupled with the external circuit.

It is to be noted that in the connection structure between the resonator and the external circuit as described above, the placement number of resonators is not limited to 1 but a plurality of resonators may be disposed as a group. An example of the connection structure between such resonators disposed as a group and a transmission line (signal conductor interconnection) is shown in the schematic perspective view of FIG. 13. It is to be noted that FIG. 13 is a transparent perspective view showing a part of the structure of the layer closest to the front surface in a multilayer dielectric substrate 101 included in a resonator group 110 having a plurality of resonators 100 disposed in array.

Figure 13:
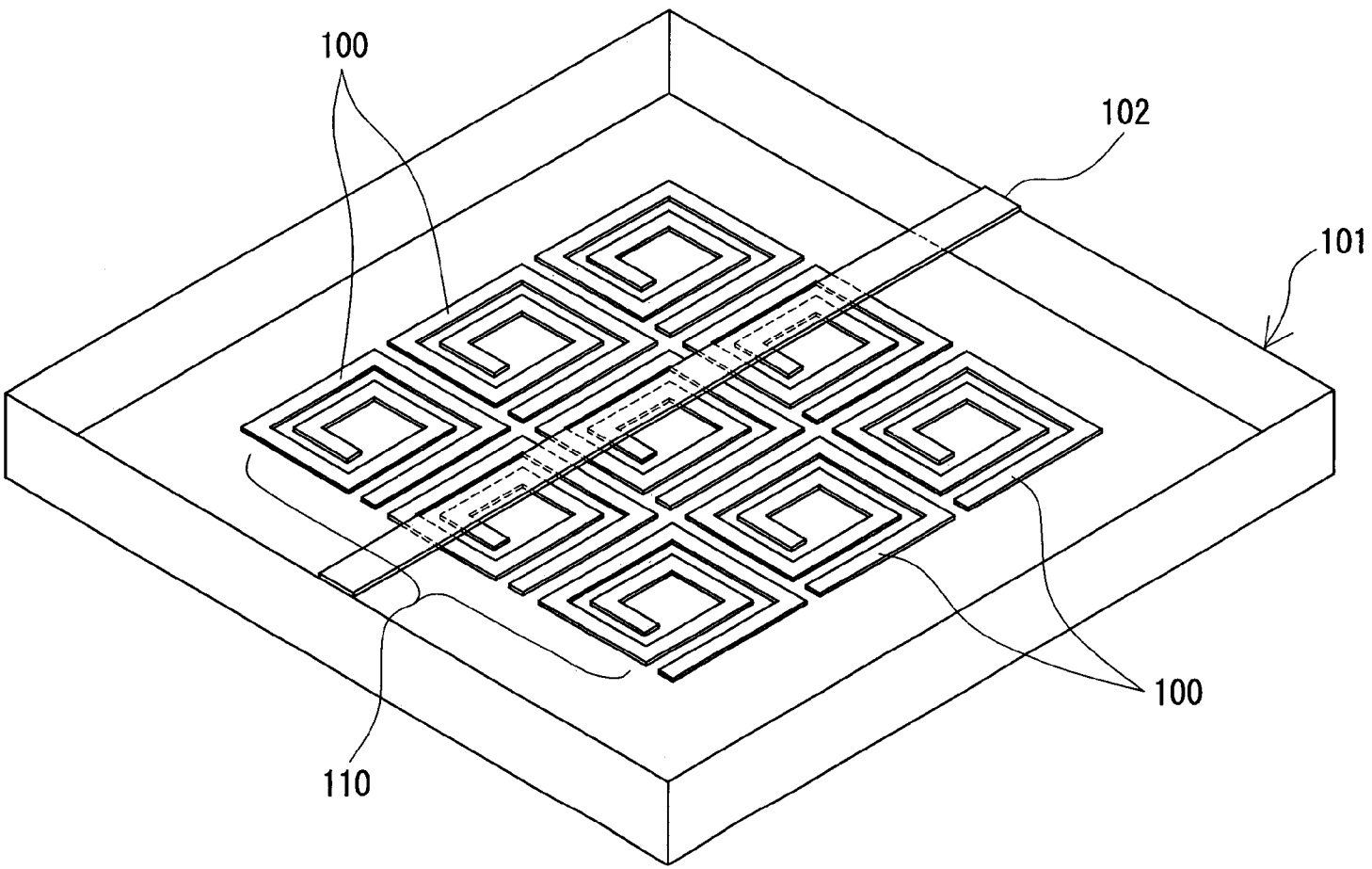
FIG. 13 is a transparent perspective view showing the connection structure between a resonator group and an external circuit.
Figure 14A:
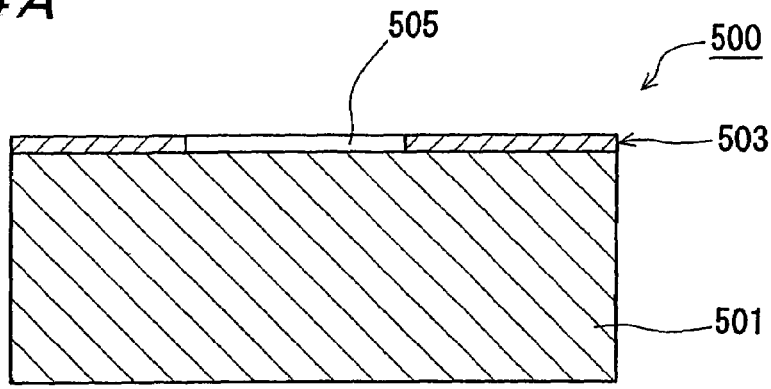
Fig. 14A (PRIOR ART)
FIG. 14A is a cross sectional view showing a conventional resonator.
Figure 14B:
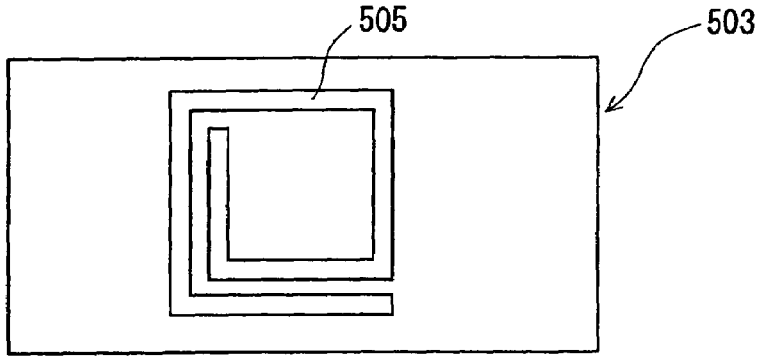
Fig. 14B (PRIOR ART)
FIG. 14B is a top view showing a ground conductor layer included in the resonator of FIG. 14A.

As shown in FIG. 13, a transmission line 102 is formed on the front surface of the multilayer dielectric substrate 101. With such structure, the resonator group 110 disposed as a group can exert intense modulation on the transmission characteristics of a transmission line 31, thereby allowing application to radio-frequency devices such as transfer units and filters.

Although in the first to fourth embodiments of the present invention, description has been given of the structure in which air is present on the top surface of the second dielectric substrate, the present invention is not limited to such cases. Instead of these cases, in the case, for example, where a third dielectric substrate is set on the top face of the second dielectric substrate, the beneficial effects of the present invention may be achieved.

In the resonators in the first to fourth embodiments of the present invention, it is effective for achieving the effect of reduction in resonance frequency to increase the cross-coupling capacitance between the laminated circuits, and it is possible to achieve the beneficial effect of further reduction in resonance frequency by setting a dielectric constant $\in$6 of the first dielectric substrate 6 and a dielectric constant $\in$7 of the second dielectric substrate 7 to satisfy the relationship of $\in 6 < \in 7$.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The disclosure of Japanese Patent Application No. 2003-354817 filed on Oct. 15, 2003 including specification, drawing and claims are incorporated herein by reference in its entirety.

INDUSTRIAL APPLICABILITY

The resonator in the present invention, which has a spiral-shaped slot set on a ground conductor layer, a spiral-shaped slot or signal conductor interconnection set on a layer different from that of the slot, is useful as a small-size resonator. Moreover, the resonator is widely applicable to uses in the fields of telecommunication such as filters, antennas, phase shifters, switches and oscillators, as well as usable in each field where radio technique such as power transmission and ID tags is used.

What is claimed is:

1. A resonator for producing a resonance phenomenon at a resonance frequency, comprising:

a dielectric substrate;

a ground conductor layer having a slot formed into a spiral shape with a turning number of one time or more, which is disposed on a back surface of the dielectric substrate;

a spiral conductor interconnection disposed on a front surface of the dielectric substrate and formed into a spiral shape with a turning number of one time or more; and a connection through conductor disposed so as to go through the dielectric substrate for connecting an inner termination portion of the spiral conductor interconnection or a vicinity thereof and a ground conductor region inside the slot in the ground conductor layer, wherein the slot and the spiral conductor interconnection overlap with each other as viewed from a top face.

2. The resonator as defined in claim 1, wherein the connection through conductor is connected to the ground conductor region in a vicinity of a spiral center of the slot in the ground conductor layer.

3. The resonator as defined in claim 1, wherein a winding direction of the slot and a winding direction of the spiral conductor interconnection are opposite to each other.

4. The resonator as defined in claim 1, wherein the slot and the spiral conductor interconnection are disposed so that, as viewed from the top face, respective spiral centers are aligned with each other and respective outer edges are almost aligned with each other.

5. The resonator as defined in claim 4, wherein an outer termination portion of the slot and an outer termination portion of the spiral conductor interconnection are disposed at positions symmetric with respect to a spiral center of the slot as viewed from the top face.

* * * * *